US005368400A

United States Patent [19]

Cyphert et al.

[11] Patent Number: 5,368,400

[45] Date of Patent: Nov. 29, 1994

[54] MARKING APPARATUS WITH CABLE DRIVE

[75] Inventors: David L. Cyphert, Canal Winchester; Roger L. Sieling, Columbus, both of Ohio

[73] Assignee: Telesis Marking Systems, Inc., Circleville, Ohio

[21] Appl. No.: 137,302

[22] Filed: Oct. 15, 1993

[51] Int. Cl.[5] ..... B41J 3/02

[52] U.S. Cl. ..... 400/124.01; 400/127; 400/130; 137/885; 101/3.1; 101/28

[58] Field of Search ..... 400/121, 124, 118, 127, 400/130; 101/4, 3.1, 28; 137/883, 885

[56] References Cited

U.S. PATENT DOCUMENTS

| | | | |
|---|---|---|---|
| 4,506,999 | 3/1985 | Robertson | 400/121 |
| 4,572,680 | 2/1986 | Kurt | 400/121 |
| 4,591,279 | 5/1986 | Speicher | 400/121 |
| 4,592,668 | 6/1986 | Kuback et al. | 101/4 |
| 4,806,741 | 2/1989 | Robertson | 235/462 |
| 4,808,018 | 2/1989 | Robertson et al. | 400/121 |
| 5,015,106 | 5/1991 | Robertson et al. | 400/121 |
| 5,037,215 | 8/1991 | Crick | 400/127 |
| 5,119,109 | 6/1992 | Robertson | 346/75 |
| 5,167,457 | 12/1992 | Cyphert et al. | 400/121 |
| 5,316,397 | 5/1994 | Robertson et al. | 400/121 |

*Primary Examiner*—Eugene H. Eickholt
*Attorney, Agent, or Firm*—Mueller and Smith

[57] ABSTRACT

Marking apparatus for moving a marking head to coordinate positions utilizing two fixed stepper motors performing in conjunction with a cable and pulley drive system. The dynamics of pneumatically driven marrker pins within marker heads are accommodated for by a topology which includes a marker support base which, in turn, is supported in force transfer relationship with an air bearing which rides over a flat platen surface. Improved marker head structure is developed utilizing a polyetherimide material and a design providing the introduction of return air into a two-component piston chamber at a location above a seating surface.

33 Claims, 12 Drawing Sheets 10
24
194
216
190
26
122
230
258
200
124
228
22
248
250
224
222
240
256
218
286
238
296
272
182
220
271
40
144
130
42
186
180
132
142
80
122
126
96
181
140
134
350
90
138
124
102
351
314
72
312
340
50
342
318
48
320
328
20
344
44
46

MARKING APPARATUS WITH CABLE DRIVE

BACKGROUND

As industry has continued to refine and improve production techniques and procedures, corresponding requirements have been levied for placing identifying, data related markings upon components of manufactured assemblies. With such marking, the history of a product may be traced throughout the stages of its manufacture and components of complex machinery such as automobiles and the like may be identified, for example, in the course of investigations by governmental authorities.

A variety of product marking approaches have been employed by industry. For example, paper tags or labels carrying bar codes may be applied to components in the course of their assembly. For many applications, such tags or labels will be lost or destroyed. Ink or paint spraying of codes such as dot matrix codes have been employed for many manufacturing processes. Where the production environment is too rigorous, however, or subsequent painting steps are involved, such an approach has been found to be unacceptable.

The provision of a permanent or traceable marking upon hard surfaces such as metal traditionally has been achieved with marking punches utilizing dies which carry a collection of fully formed characters. These "full face dies" may be positioned in a wheel or ball form of die carrier which is manipulated to define a necessarily short message as it is dynamically struck into the material to be marked. As is apparent, the necessarily complex mechanisms involved are prone to failure and full face dies exhibit rapid wear. Generally, the legibility and abrasion resistance of the resultant marks can be considered to be only fair in quality. Additionally, the marking punch approach is considered a poor performer in marking such surfaces as epoxy coatings and the like.

Laser activated marking systems have been employed. However, such systems are of relatively higher cost and the abrasion resistance and "readability after painting" characteristics of laser formed characters are considered somewhat poor.

U.S. Pat. No. 4,506,999 by Robertson, issued in 1985, entitled "Program Controlled Pin Matrix Embossing Apparatus" describes and claims a computer driven dot matrix marking technique which has been successful in the marketplace. This marking approach employs an array of tool steel punches which are uniquely driven using a pneumatic floating pin impact concept to generate man readable and/or machine readable dot characters or codes. Marketed under the trade designation "PINSTAMP", these devices carry the noted steel punches or "pins" in a head assembly which is moved relative to the workpiece being marked at selected skew angles to indent a dot or pixel defining permanent message or code into a surface. The system enjoys the advantage of providing characters of good legibility as well as permanence. Additionally, a capability for forming the messages or codes during forward or reverse head movements is realized. Use of the basic dot matrix character stamping device is limited, however, to piece parts which are both accessible and of adequate size.

Robertson, et al., in U.S. Pat. No. 4,808,018, entitled "Marking Apparatus with Matrix Defining Locus of Movement", issued Feb. 28, 1989, describes a dot matrix character impact marking apparatus which is capable of forming messages or arrays characters within a very confined region. With this device, a linear array of marker pins is moved by a carriage in a manner defining an undulating locus of movement. This locus traces the matrix within which character fonts are formed by the marker pins. The carriage and head containing the marker pins are pivotally driven by a cam to provide vertical movement and by a Geneva mechanism to provide horizontal movement. Pixel positions for the matrices are physically established in concert with pin or carriage locations by a timing disk and control over the pins is generated in conjunction with an interrupt/processor approach. Each marking pin of the pin array within the head assembly of this portable device is capable of marking more than one complete character for a given traverse of the head between its limits of moment.

Robertson, et al., in U.S. Pat. No. 5,015,106, issued May 14, 1991, and entitled "Marking Apparatus with Multiple Line Capability" describes a dot matrix character impact marking apparatus which achieves a multiple line capability wherein a carriage component carrying one or more marker pin cartridges moves within a singular plane locus of movement. This multiple line capability advantageously has permitted a broad variety of line configurations, for example in widely spaced positions at a workpiece. The device further employed a retrace method in generating a locus of marking movement somewhat similar to the formation of a raster in conjunction with television systems. A modular approach for the device was provided utilizing a forward housing carrying the locus defining component of the device which was then actuated from a rearwardly disposed motor containing housing component which served to drive cam assemblies at the forward portion. The carriage component of the device carried a manifold which, in turn, carried one or more marker pin cartridges, the pins of which were driven from an externally disposed valved and pressurized air supply. As before, the device performed in conjunction with a predetermined character defining matrix of pixel positions, each position of the matrix being identified to the system by a timing disk physically maneuvered with the drive components.

The success of the above products has led to further calls on the part of industry for even more compact marking systems of lower weight and higher rates of marking speed. Further, interest has developed in providing a broad range of marking capabilities for the type devices at hand. Robertson, et al., in U.S. Pat. No. 5,316,397, entitled "Marking Apparatus With Multiple Marking Modes", issued May 31, 1994, describes a matrix form of character marking utilizing a single plane undulatory motion of the pin cartridge carrying carriage, as well as a capability for the above-described raster form of locus of movement. This flexibility is achieved through the utilization of software changes as opposed to the insertion of hardware-based timing components and the like. The system disclosed exhibits a capability for full form character formation. This requires the actuation of the marker pins in a manner wherein discrete dots or pixels are not observable, the indentations formed by these pins being so closely nested as to evoke the image of a continuous line forming each character.

The floating pin impact concept initially introduced by Robertson has led to a variety of applications on the part of investigators. For example, in Cyphert, et al., U.S. Pat. No. 5,167,457, entitled "Apparatus and Method for Marking Arcuately Configured Character Strings", issued Dec. 1, 1992, and assigned in common herewith, the marking approach is adapted to the formation of character strings in arcuate fashion. Similarly, the approach was adapted to systems for marking the curved inner surface of pipes as described in U.S. Pat. No. 5,119,109, by Robertson, entitled "Method and Apparatus for Marking the Inside Surface of Pipes", issued Jun. 2, 1992, and assigned in common herewith.

The reading of dot matrix characters and codes following their formation may be carried out by a video based system described in U.S. Pat. No. 4,806,741, by Robertson, entitled "Electronic Code Enhancement for Code Readers", issued Feb. 21, 1989, and assigned in common herewith.

Certain marking applications of the floating pin impact concept call for the use of a single marking pin as opposed to an array of pins. Guidance of this form of single pin typically has been carried out utilizing robotic systems. One such system currently is marketed under the trade designation "TMP 6000" by Telesis Marking Systems, Inc., of Circleville, Ohio.

Investigators now are seeking to improve the performance of these marking systems in terms both of speed and dot or indentation quality. Speed of marking generally is constrained by the air pressure limits of solenoid actuated valves and delivery systems. Thus, enhancements of this operational parameter have been sought to be achieved with efficient valve actuation and improved pin-cartridge design. Dot quality aspects involve both the controlled depth of the dot formation, as well as proper positioning of the dot in the construction of character symbols and codes. Heretofore, the hardened steel pins employed with the arrays have been slidably mounted within chambers formed in steel or surface hardened aluminum cartridges. These cartridge chambers have been observed to wear, a condition leading to degrading pin marking performance. Lubrication for the rigorous pin dynamics involved has been through the introduction of lubricant into driving and return air functions of the system. Poor control over the amounts of such lubricant employed leads to undesirable variations in the quality of dot formation. In general, the structures which have been heretofore developed have been of a somewhat robust nature in view of the forces involved in driving the pins into impact with a metal surface and the return of the pins. Where a pin "misses" or fails to strike a surface to be marked, then impact dynamics are visited upon the marking system. Such dynamics must be accommodated in any design. Of current interest, it has been apparent that it is desirable to expand the utilization of this form of marking to the identification of components of a broader variety of products. This calls for the development of marking systems which retain the quality of marking heretofore achieved, but which are of lesser cost and, preferably, which are much lighter, notwithstanding the dynamics of character formation involved.

SUMMARY

The present invention is addressed to a marking apparatus of relatively light structure having the capability of accurately and rapidly positioning a marker head at coordinate defined locations within a marking field. Utilizing two, fixed motor drives, for example, of a stepper variety, the marker head is positioned by a very light system of cables and pulleys, the cables being positively driven by a capturing capstan configuration at the outputs of the two motors. Accommodation of the relatively light apparatus to the rigorous dynamics associated with the impacting and rebounding of a pneumatically driven steel marker pin system is achieved through the utilization of a stiff air bearing support of a lightweight marker base. In this regard, the marker base, which preferably is formed of plastic, is supported in force transfer relationship over the air bearing which, in turn, rides over a flat platen support surface.

Provided with the marking device drive is an improved, lightweight marker head component. Formed of polyetherimide material, the head structure exhibits adequate strength and a self-lubricating quality advantageously eliminating the need for introducing a lubricant into drive and return air feeds. Operating in conjunction with an improved steel pin structure, the head component develops an air cushioning protective effect for incidences of marker pin "miss" conditions through the elimination of a return air pin chamber component and the unique positioning of the return air port within the chamber.

Other features of the invention will, in part, be obvious and will, in part, appear hereinafter. The invention, accordingly, comprises the apparatus providing the construction, combination of elements, and arrangement of parts which are exemplified in the following detailed disclosure.

For a fuller understanding of the nature and objects of the invention, reference should be had to the following detailed description taken in connection with the accompanying drawings.

DETAILED DESCRIPTION OF THE DRAWINGS

In the discourse to follow, the structuring operation of the marker assembly of the invention will be seen to reflect an avoidance of the heavy and robust structures heretofore developed. Those robust structures generally have been designed for employment in rigorous industrial environments and, particularly, to accommodate for the rather substantial forces encountered as steel marking pins are pneumatically driven into hard surfaces such as steel to form characters and codes using an indentation-based approach. The instant apparatus, for the most part, achieves such results but with comparatively delicate mechanisms which still perform in conjunction with the dynamics of steel pin marking. Because of a unique associated head construction, improved pin or indentation formation performance is recognizable.

Figure 1:
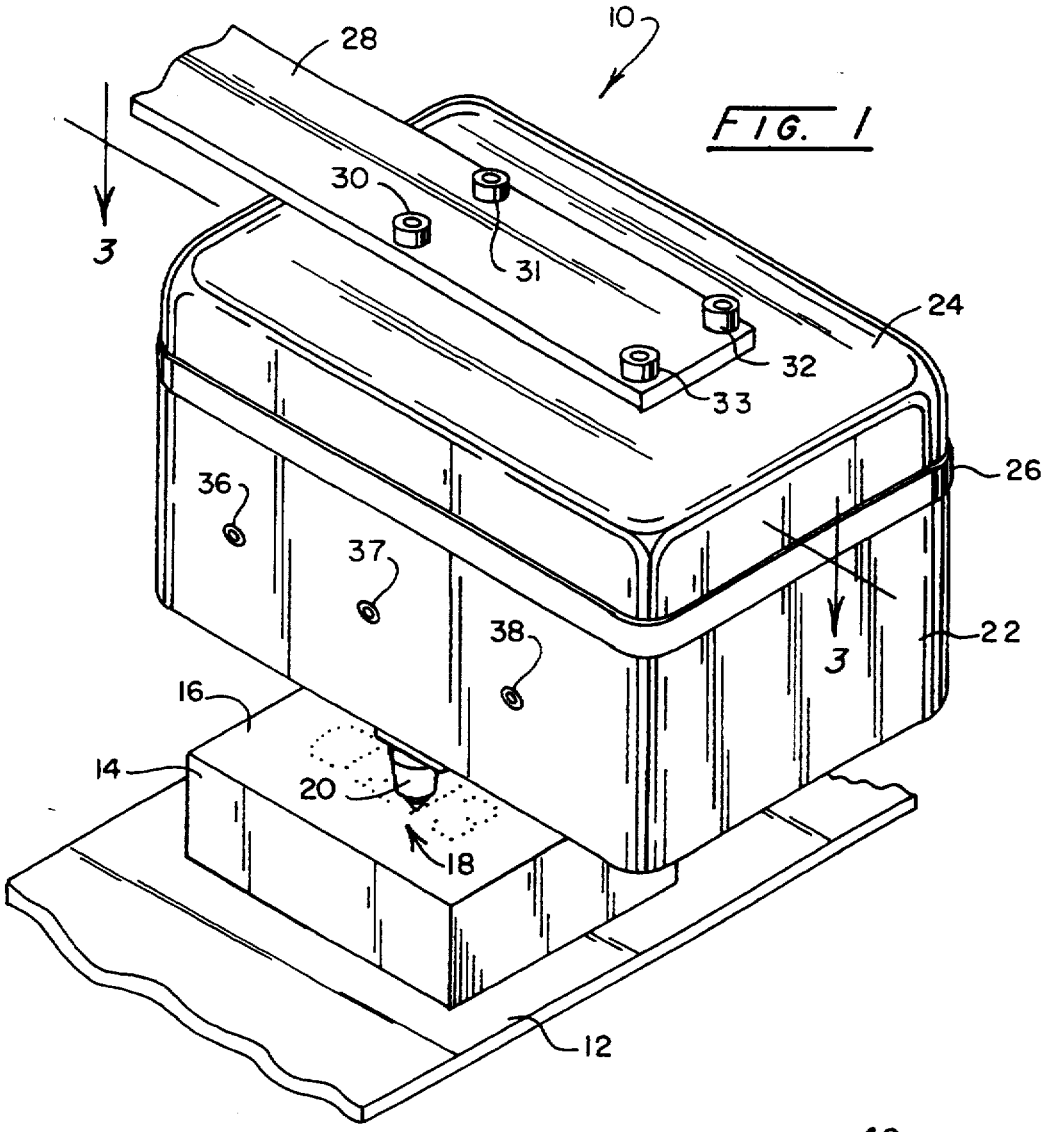
FIG. 1 is a perspective view of apparatus according to the invention shown in operative association with a piecepart and support therefor.

Referring to FIG. 1, the apparatus of the invention is revealed in perspective in general at 10 in conjunction with a stylized form of workpiece support represented, for example, as a conveyor surface 12. Surface 12 is seen to support a representation of a piece part 14 having an upper surface 16 which is seen to have been marked with dot matrix-based characters represented generally at 18. It is highly desirable that these characters 18 be formed with uniform dot-like indentations or pixels to promote easier reading. Where these characters are formed, for example, as codes intended for machine reading, then the quality of this dot marking is quite important. While a dot matrix character formation is shown for exemplary purposes, the apparatus 10 is capable of making "continuous" character forms wherein the individual dot indentations are not discretely visible, a continuous line formation being perceived by the viewer. Characters 18 are seen to have been formed by a pin-based marking device, the head or cartridge component of which is revealed generally at 20 and which extends downwardly from apparatus 10 through a lower removable cover 22. Lower cover 22 joins with an upper cover 24 through a somewhat wide polymeric gasket 26. Gasket 26 is dimensioned so as permit an access to control components by the operator without the necessity of removing the cover component 24 as well as that at 22. The entire assembly 10 is seen attached to a retainer device 28 by machine screws as at 30–33 which extend into internal structure. Similarly, such screws, three of which are revealed at 36–38, retain the lower cover 22 in position by attachment to internal structure. Apparatus 10, in its entirety, is comparatively light, a typical mechanical device weighing, for example, about 10 pounds (22 Kg).

Figure 2:
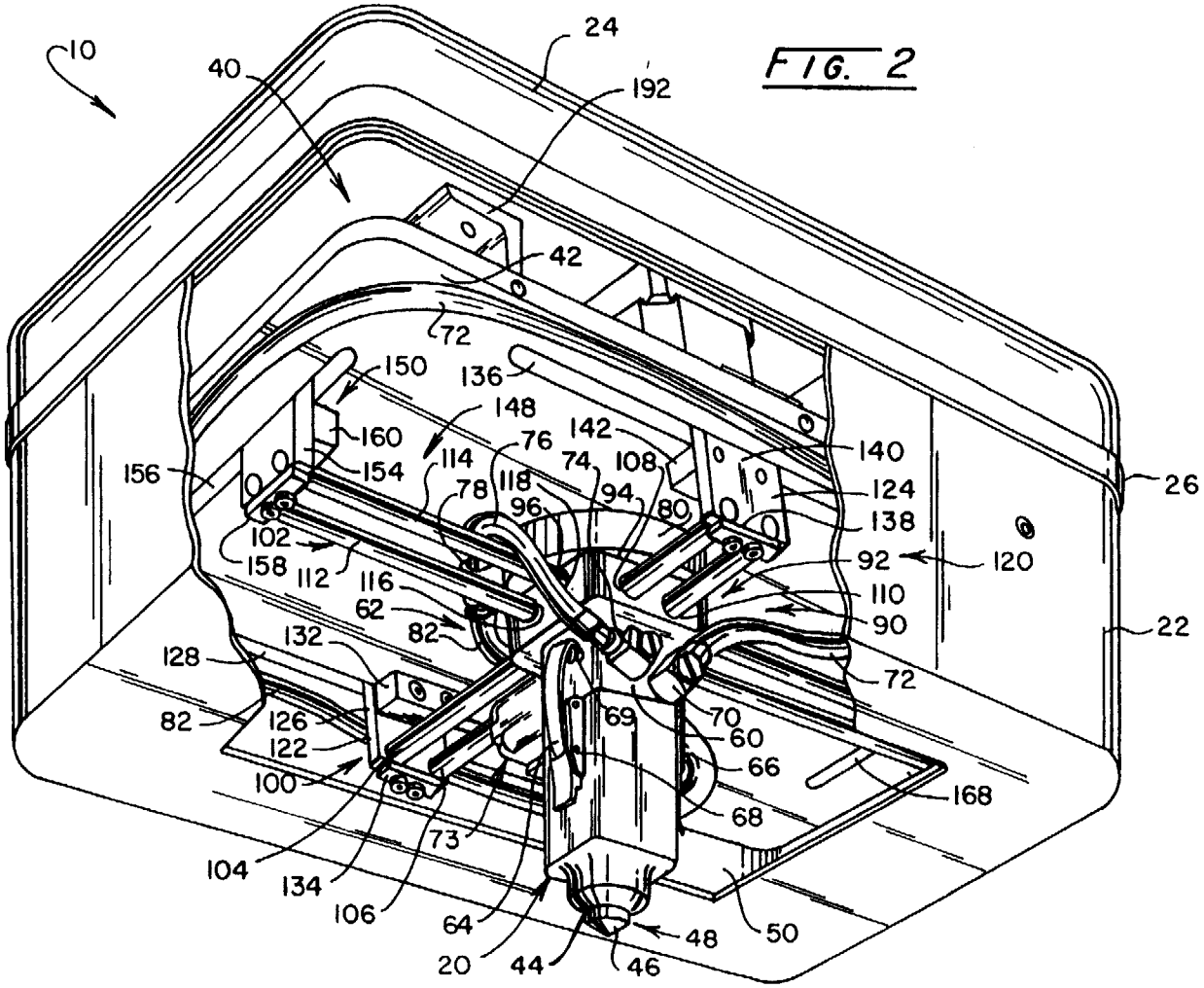
FIG. 2 is a perspective view of the apparatus of FIG. 1 with portions broken away to reveal internal structure.

Referring to FIG. 2, broken away representation of the apparatus 10 is revealed. In the figure, a support member is represented generally at 40 which is configured for attachment with the retainer device 28 (FIG. 1). Support member 40 is configured having a downwardly facing flat paten surface 42 which is of area extent to provide field support defining peripheries within which the marking assembly including head component 20 is maneuverable. Head 20 is seen having a confronting surface or edge 44 through which the conical indentation tip 46 of a steel marker pin represented generally at 48 protrudes. Head or cartridge 20 receives drive and return control actuating pneumatic inputs from the manifold 60 of a valve controlled pneumatic assembly represented generally at 62. The head or cartridge 20 is couple to manifold 60 by a connector assembly formed of two draw latches 64 and 66 which are of identical construction. In this regard, the latch 64 is seen having a lever actuated connector component 68 which is coupled to one face of head 20 and which extends to a second component stud 69 to provide an over-center tightening connection. Manifold 60 provides return and supply air to the head cartridge 20. In this regard, return air is supplied through a pneumatic fitting or connector 70 from web-reinforced flexible pneumatic hose 72. This return air functions to urge the marker pin 48 into a retracted pre-strike orientation within the head 20. Drive air intended for introduction to a solenoid-actuated valve shown generally at 73 is provided through a drive air pneumatic fitting 74 which, in turn, is fed from a web-reinforced flexible pneumatic hose 76. Of particular interest, the hose 76 is seen to be coupled with another fitting 78 which functions to supply pneumatic drive air to an air bearing represented at 80. Fitting 78, in turn, receives drive air from flexible web-reinforced pneumatic hose 82. Hose 82 is coupled with a source of dry air under pressure and is seen to be wound about the outer periphery of structure 40. It may be noted with the arrangement shown that bearing device 80 as well as the drive air input to solenoid actuated valve 72 are coupled in parallel, an aspect demonstrating that the air demand of the bearing device 80 is relatively low and that the system does not perform with air which contains a lubricant as has been required in marking systems of the past. The term "air" as used herein is intended to refer to atmospheric air or other gaseous fluids suited to the purpose at hand.

Manifold 60 preferably is integrally formed and represents a downwardly extending portion of a marker base represented generally at 90 and which includes additionally an upper channel or bore defining portion 92 which extends to an inwardly disposed portion or surface 94 which is located in close adjacency with the outwardly-disposed surface 96 of air bearing 80.

Marker base 90 is supported a predetermined distance above platen surface 42 of support member 40 by two cross-bar assemblies shown generally at 100 and 102. These assemblies 100 and 102 are of relatively light construction. In this regard, it may be observed that cross-bar assembly 100 is formed of two parallel steel rods 104 and 106 which slidably engage corresponding bores 108 and 110 extending through the upper channel defining portion 92 of marker base 90. In similar fashion, cross bar assembly 100 is formed of two, parallel steel rods 112 and 114 which slidably extend through corresponding bores 116 and 118 within the upper channel defining portion 92 of marker base 90. In this regard, note that the assembly 102 is positioned inwardly of assembly 100 as it slidably extends through portion 92. To promote the slidability of assemblies 100 and 102 within the upper channel defining portion 92 of marker base 90, the latter base preferably is formed of a polyetherimide exhibiting high strength and rigidity at high temperatures as well as long term heat resistance. The material generally is self-lubricating, thus avoiding the need for lubricant in conjunction with the supporting drive arrangement shown. Marketed under the trademark "ULTEM", such polyetherimides are shown, for example, in U.S. Pat. Nos. 3,787,364; 3,917,643; and 3,847,867, which are expressly incorporated herein by reference.

Cross bar assembly 100 functions to move the head or cartridge 20 in an x-coordinate sense. To provide for this activity, the relatively thin, i.e. ¼ inch diameter rods 104 and 106 are seen to extend to the peripheral region of the platen surface 42 of support member 40 to be engaged by a translational bearing assembly represented generally at 120 and formed of T-shaped polymeric bearing components 122 and 124. Formed, for example, of polyethylene, component 122 is configured having a pier portion 126 extending through an elongate narrow slot 128 formed through the periphery of platen surface 42. Looking additionally to FIG. 3, the pier portion 126 extends from and is integrally formed with a rectangular base portion 130, and, with the arrangement shown, the component 122 is slidable within the slot 128. Base portion 130 is retained in abutment against the underside or surface of structure 40 by a small, rectangular keeper seen in FIG. 2 at 132. That figure also reveals that the rods 104 and 106 are retained in appropriate position at the top of pier portion 126 by a compression block or cap and machine screw assembly 134. FIG. 2 reveals that T-shaped bearing component 124 is identically structured, having a pier portion 140 slidably retained within elongate slot 136 by a keeper 142, and, as revealed in FIGS. 3 and 5 having an integrally formed base portion 144 slidable therewith along the locus identified by slot 136.

Figure 3:
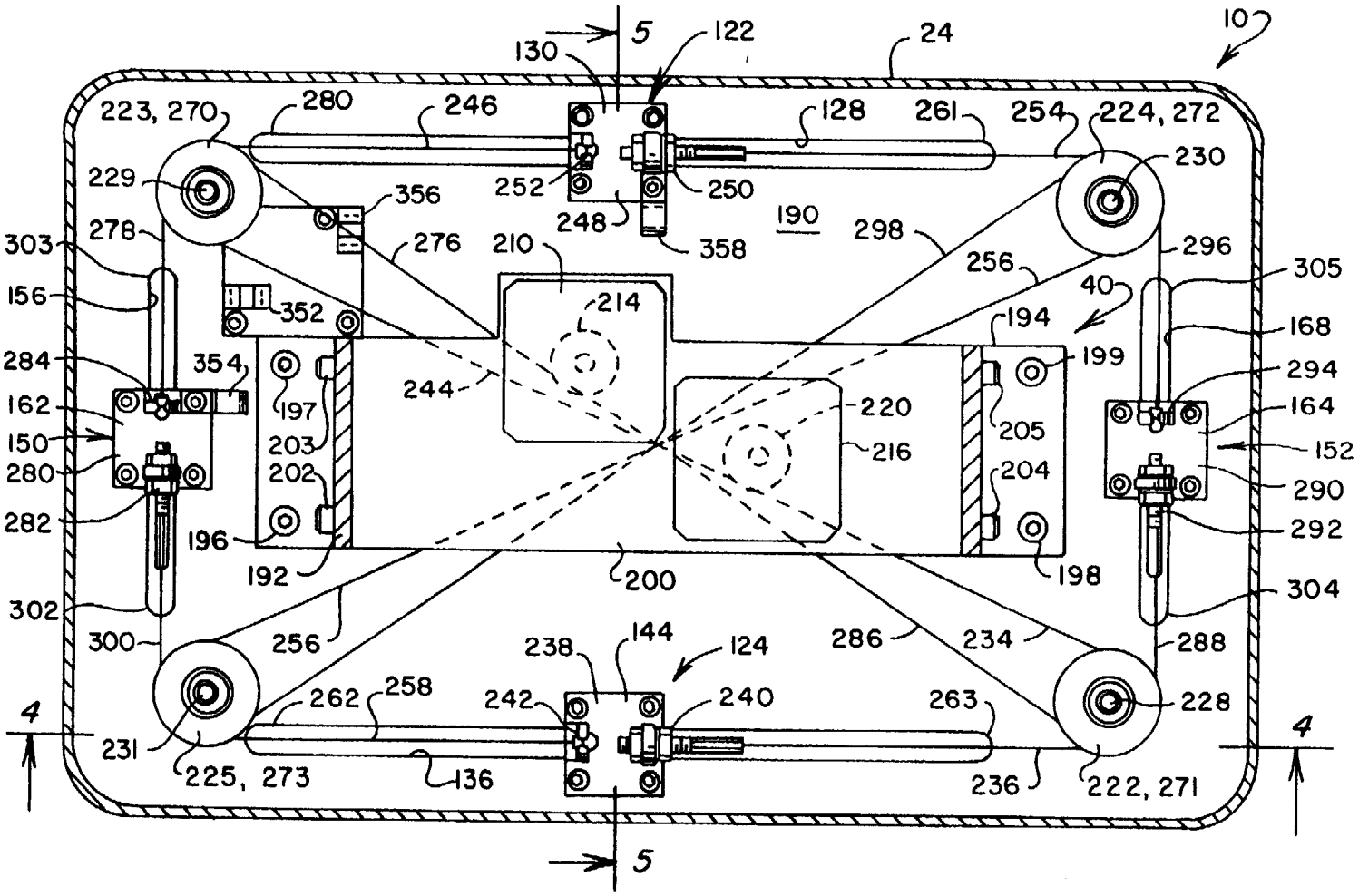
FIG. 3 is a sectional view taken through the plane 3—3 shown in FIG. 1.
Figure 4:
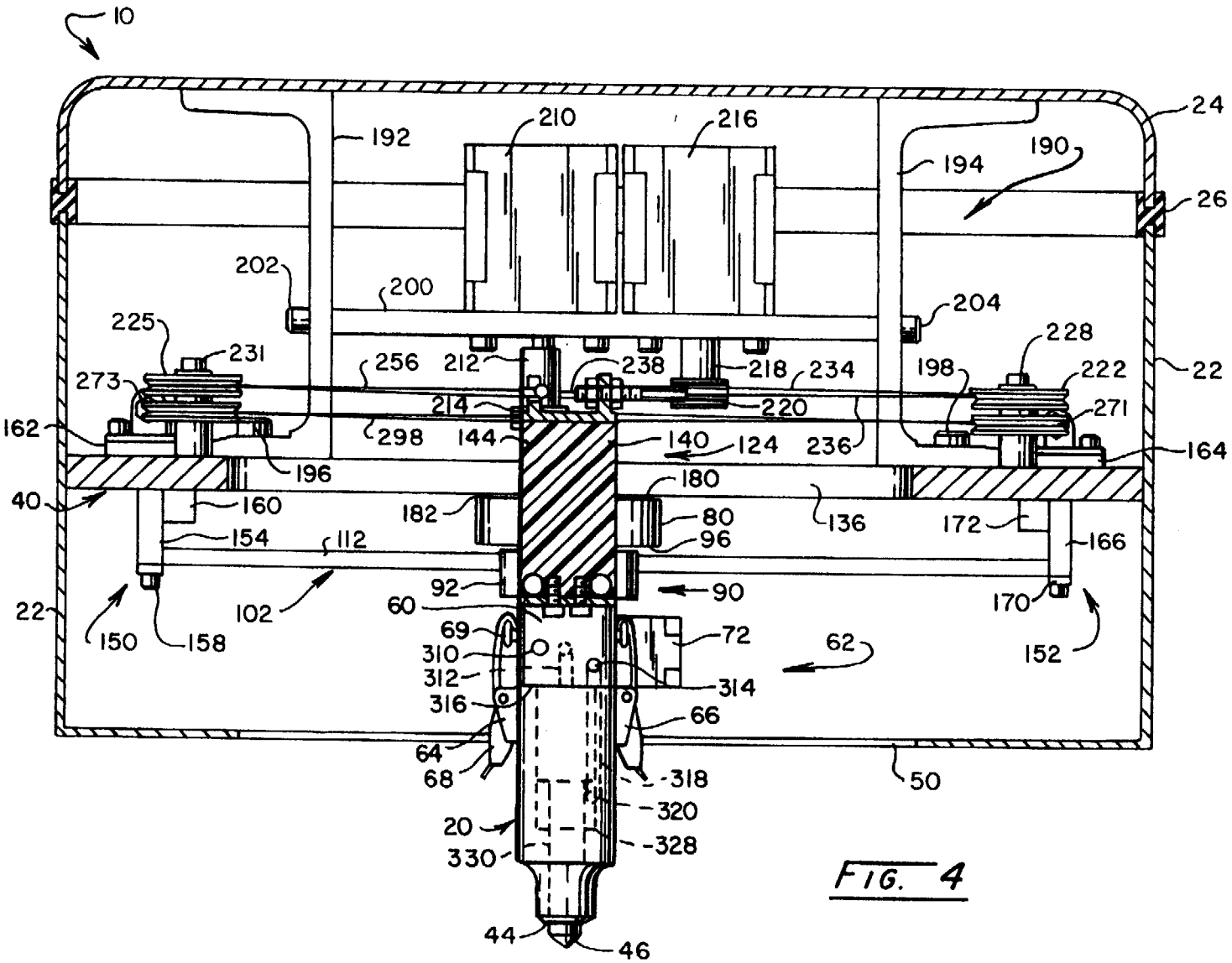
FIG. 4 is a sectional view taken through the plane 4—4 shown in FIG. 3.

Head component 20 is moved in what may be considered a y-coordinate sense by cross bar assembly 102 which performs in conjunction with a translational bearing assembly represented in general at 148 and formed of T-shaped polymeric bearing component 150 (FIG. 2) and corresponding T-shaped bearing component 152 (FIGS. 3, 4). As before, T-shaped bearing component 150 is formed having a pier portion 154 which extends in sliding relationship through an elongate slot 156 to receive the rods 112 and 114 of cross bar assembly 102. The latter rods 112 and 114, as before, are retained in position for slidable mement by a compression block or cap and machine screw assembly 158, while the component 150 is retained in position by a keeper 160. The integrally-formed base portion of the bearing component 150 is seen in FIGS. 3 and 4 at 162.

FIGS. 3 and 4 reveal that the T-shaped polymeric bearing component 152 is identically structured, having a base portion 164 and an integrally formed pier portion 166 extending through elongate slot 168 to receive the rods 112 and 114. These rods are retained in position by compression block or cap and machine screw assembly 170 (FIG. 4). As before, a keeper 172 retains the bearing component 152 appropriately within the slot 168. Both T-shaped polymeric bearing components 150 and 152 are formed of polyethylene material and thus, are slidable within respective slots 156 and 168.

Figure 5:
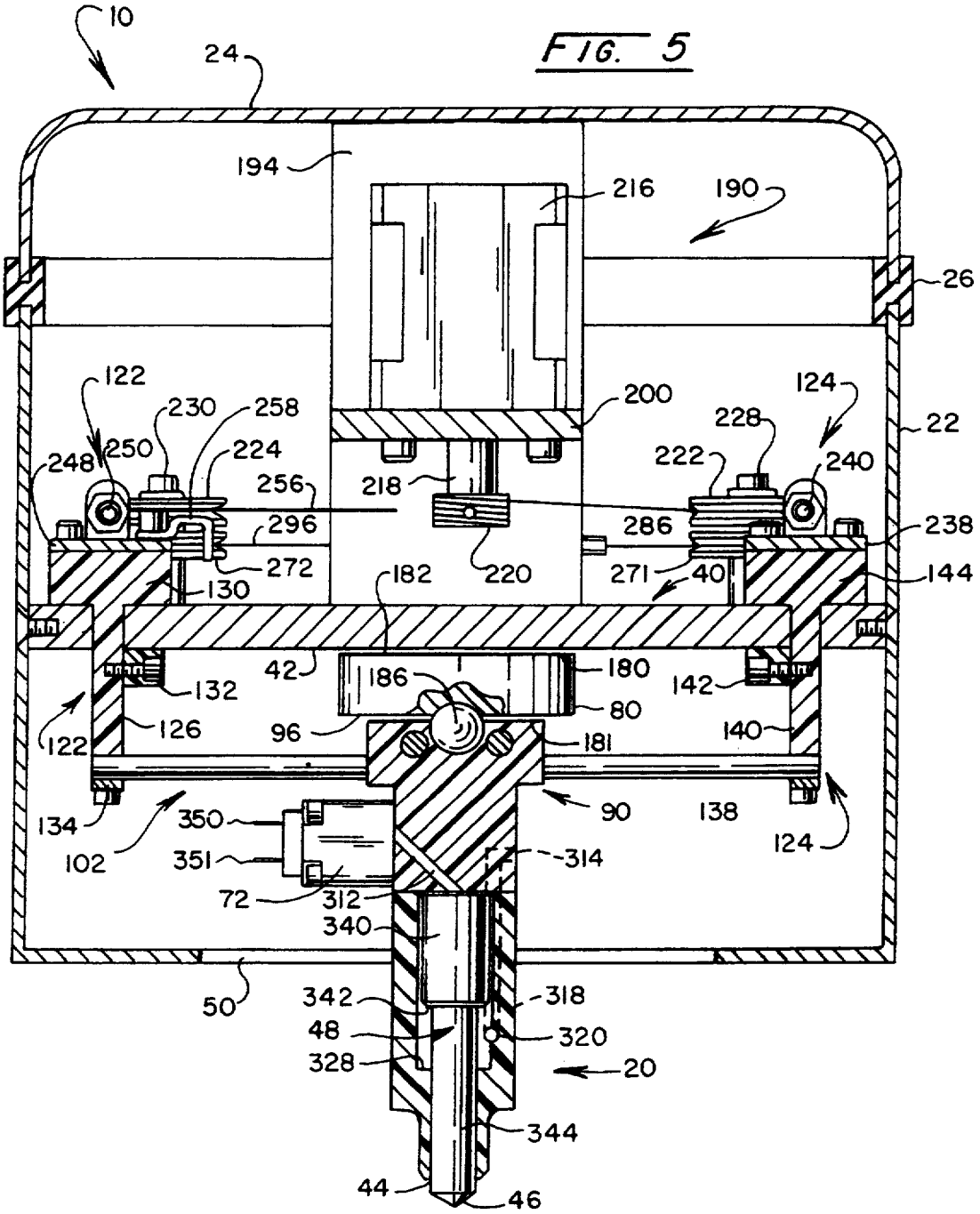
FIG. 5 is a sectional view taken through the plane 5—5 shown in FIG. 3.

Looking again to FIG. 2, it may be observed that with the structuring shown, movement of the polymeric bearing components 122, 124 and 150, 152 will impart a corresponding x- and y-based coordinate motion to the marker base 90-pneumatic assembly 62 and associated head or cartridge component 20. To provide appropriate clearance for this slidable interaction at the marker base 90, the pier portions 124 and 126 of bearing components 122 and 124 are made to extend further outwardly in than the corresponding pier portions of bearing components 150 and 152. As is apparent, the structure utilizing cross bar assemblies 100 and 102 in conjunction with the polyetherimide marker base 90 is relatively delicate as compared with the robust systems generally encountered. Air bearing 80 accommodates for this relatively light structuring. In this regard, the disk-shaped air bearing 80 preferably is one formed of porous carbon having an air-expressing bearing surface which is seen in FIGS. 4 and 5 at 180 operationally spaced from platen surface 42 by a substantially constant gap of, for example 0.00004 inch as represented at 182. For porous carbon type air bearings, as air diffuses through the whole surface 180, there are no high or low pressure areas, and there results a more uniform pressure within the air gap. The result and important performance characteristic then becomes one of the stiffness exhibited where stiffness is defined as the change in the air gap in response to varying loads. This stiffness for the instant arrangement is quite high, being able to accommodate all of the loads typically encountered for the instant application. Another advantage derived by the porous carbon form of air-bearing resides in the relatively lower air demands imposed by it. This also permits the parallel input of drive air to both the manifold 60 and bearing 80. For a 1½ inch diameter active area of bearing 80 at a 60 psi pressure, the device will draw about 1½ cubic feet of air per hour. The corresponding conventional air draw required by marker head 20 is about 1½ to 2 cubic feet of air per minute. These values are well within the realm of practicality within the industrial environment. A matrix-type air bearing, for example, having 36 holes, typically will draw about 1½ to 2 cubic feet of air per minute, a sizable increase over that of the porous carbon variety. To provide for the transference of force vectors perpendicularly into the center of bearing 80, a force coupler is positioned intermediate the marker base 90 upper or inwardly disposed portion of surface 184 and the air bearing 180. FIG. 5 reveals this coupler to be a rigid ball or sphere 186, for example a steel bearing ball positioned within partially hemispherical detents formed both within the outwardly depending surface of bearing 80 and inwardly depending surface 186 of marker base 90. In general, such air bearings, as at 80 are sold under the trade designation "AEOLUS" by Devitt Machinery Co. of Aston, Pa. With the arrangement shown, the assemblage of the air bearing 80, coupler associated marker base 90, and head 20 may be driven about the platen surface 42 by cross bar assemblies 100 and 102 to carry out appropriate positioning of the marker pin 48 for actuation in a marking mode.

Looking to FIGS. 3 and 4, the drive arrangement for maneuvering the cross bar assemblies 100 and 102 to carry out head positioning is represented in general at 190. Drive arrangement 190 is supported from the support structure 40 which, at rite top of the apparatus 10, is seen to include two outwardly facing channel members 192 and 194 which, in turn, are attached to support 40 by machine screws seen in FIG. 3 at 196–199. Positioned above support 40 and coupled between the channel members 192 and 194 is a platform 200. Platform 200 is seen attached to channel 192 by machine screws 202 and 203 (FIG. 3) while correspondingly, the platform 200 is coupled to channel 194 by machine screws 204 and 205.

FIG. 4 reveals that platform 200 supports a y-coordinate driving stepper motor 210, the rotational output of which is provided at shaft 212 and to which an externally threaded capstan 214 is coupled. Similarly mounted upon support 200 is an x-coordinate driving stepper motor 216 having a rotational output at shaft 218 to which an externally threaded capstan 220 is coupled. Note that the capstan 220 is at a relatively higher elevation with respect to platform 200 than is capstan 214 coupled to motor 210. This accommodates for the two levels of cable drive which are present in the drive arrangement 190. Inasmuch as the capstan 220 drive output of stepper motor 216 is at a higher elevation than that at 214 associated with stepper motor 210, in FIG. 3, the uppermost cable-based drive system associated with motor 216 is immediately presented to the observer. FIG. 3 reveals the presence of four upper level or x-coordinate, freely-rotating pulleys 222–225 attached to respective shafts 228–231. The relative elevation of these pulleys is exemplified, for example, in FIG. 4 showing pulleys 222 and 225 mounted upon respective shafts 228 and 231. Pulley 222 and associated shaft 228 also are seen in FIG. 5 as well as pulley 224 and shaft 230. The pulley and cable form of drive as associated with the two stepper motors 210 and 216 contributes to the lightness and simplicity of the apparatus 10. In this regard, it may be observed that both motors 210 and 216 are fixed to the support structure. In this regard, one motor is not moved by the other to necessitate a more robust support structuring.

In FIG. 3, the cabling topology of drive arrangement 190 is revealed. Looking initially to the x-coordinate drive system as associated with stepper motor 216, capstan 220 serves to assert a drive rotational output upon a captured cable, one portion of which is seen at 234 extending from the capstan to, in turn, extend about x-coordinate pulley 222, whereupon it exits from that freely-rotating pulley at 236 to be connected with T-shaped polymeric bearing component 124. In this regard, and as additionally seen in connection with FIGS. 4 and 5, a cable coupler 238 is connected to base 144 of the bearing 124. This coupler includes a threaded tension adjusting connector 240 which is coupled with cable component 236 and a non-adjusting capturing component 242 positioned oppositely therefrom upon coupler 238. The cable portion 234 is captured by the rotational output of motor 216 and associated capstan 220 by a ball and swaging arrangement (not shown). Cable 234 is wound about the threaded external periphery of the capstan as represented in FIGS. 4 and 5. The extent of this wrapping is selected in accordance with the distance of movement of the bearing component 124 or that at 122 within corresponding respective slots 136 and 128.

Cable extending oppositely from the capture thereof at capstan 220 also is wrapped about the capstan and is directed, as represented by cable component 244 to freely-rotating pulley 223, whereupon it exits therefrom as at 246 to be connected with translational bearing 122. The base of translational bearing 122 is configured in the same manner as that at 124. In this regard, a cable coupler 248 is attached thereto. Coupler 248 includes a threaded tension adjusting connector 250 and a non-adjusting capturing component 252. The latter component 252 is seen coupled to cable portion 246.

To provide assured positive drive to the translational bearings 122 and 124, a follower flexible cable also is connected between them. In this regard, a follower cable portion 254 extends from threaded tension adjusting connector 250 at translational bearing 122 to extend about freely-rotating pulley 224. The cable exits from pulley 224 at 256 to be wound about freely-rotating pulley 231 and exits from pulley 231 at portion 258 to be connected to the non-adjusting capturing component 242 of translational bearing 124. With the arrangement shown, each of the translational bearings 122 and 124 are maintained in non-yielding tension and are positively driven from the capstan 220 of stepper motor 216. With appropriate directional and distance actuation inputs to motor 216, translational bearing 122 is moved within elongate slot 128 between oppositely disposed termini 260 and 261 while, simultaneously, translational bearing 124 is driven in the same direction between oppositely disposed termini 262 and 263. In general, about 2½ turns of the cable, for example at components 234 and 244 about capstan 220, are called for in the positive drive approach at hand. For the instant embodiment, one rotation of the capstan 220 corresponds with two inches of linear travel at the translational bearings 122 and 124. The cable employed is formed of seven bundles of stainless steel, each bundle having 19 strands of wire and the arrangement being covered with a nylon jacket for providing a total cable diameter of 0.024 inch. Such cable provides a 40 pound breaking strength. Inasmuch as a follower cable is employed, there is a total of an 80 pound minimum breaking strength for the system at hand. The diameter of capstan 220, for example, may be provided as a value of 2 inches divided by $\pi$ or about 0.6366 inch. Adequate angles of attack of the cable to the idler pulleys 222–225 is developed by providing them at about a 1 inch diameter which achieves about at 30° angle of attack.

The cable drive associated with y-coordinate driving stepper motor 210 is quite similar to that associated with motor 216. However, as noted above, this system is at a lower or more outwardly disposed elevation within the apparatus 10 as revealed in connection with FIG. 4. To facilitate the description of the cable topology for the associated y-coordinate movement, the pulleys at the more outward elevation which are coaxial with freely-rotating pulleys 222–225 are identified in FIG. 3 following a comma associated with the former numbers. Thus, these y-coordinate level pulleys now are identified at 270–273. Looking to FIG. 3, a first cable component extends from its capture at capstan 214, being wound about the capstan for about 2½ turns, whereupon it exits as cable component 276 to extend about freely-rotating pulley 270 and continues as cable component 278 to connection with translational y-coordinate bearing 150. Similar to the x-coordinate translational bearings, bearing 150 is configured having a cable coupler 280 bolted to the base 162 thereof. Coupler 280 includes a threaded tension adjusting connector 282 and a non-adjusting capturing component 284 positioned oppositely therefrom. It may be noted that cable component 156 is coupled to the latter capturing component 284.

Wound about and extending from the capstan 214 is another cable component or portion 286 which extends to freely-rotatable pulley 271 and extends therefrom at cable portion 288 for connection to translational bearing 152. The base 164 of translational bearing 152, as in the case of the other translational bearings, includes a cable coupler 290 which is attached thereto by machine screws. The coupler 290 includes a threaded tension adjusting connector 292 which is seen attached to cable portion 288, and a non-adjusting capturing component 294.

The y-coordinate drive system also includes a follower flexible cable to assure that both of the translational bearings 150 and 152 are driven positively and accurately. In this regard, the initial portion of the follower cable at 296 is seen coupled to non-adjusting capturing component 294 and then extends about freely-rotating pulley 272. This cable exits from pulley 272 as represented at 298, whereupon it extends to freely-rotating pulley 273. The follower cable then exits from freely-rotating pulley 273 at portion 300 for connection to translational bearing 150 at the threaded tension adjusting connector 282. With the arrangement shown, upon appropriate controlled actuation of stepper motor 216, translational bearing 150 is driven between its oppositely disposed termini represented at 302 and 303 while simultaneously and correspondingly, translational bearing 152 is moved between its termini represented at 304 and 305. As is apparent, tension adjustment for both the x-coordinate and y-coordinate drive systems may be provided by the user by adjusting the threaded connections at 240, 250, 282, and 292. The non-adjusting capturing components as at 242, 252, 284, and 294 may be provided as upstanding "snap-on" slots which cooperate with swaged ball tips or the like attached to the associated cable portion ends. Generally, a tensioning tool is used to assure consistent tension within the system. The arrangement provides for a very light x,y positioning system. Because of the utilization of the air bearing 80, the components which are driven by the cable based system themselves may be quite light, the bearing 80 being of relatively low weight and the marker base assembly 90 being relatively light due to its formation in the noted polyetherimide plastic. While the steel pin 48 may strike a surface to be marked at peak forces of 100 to 200 pounds, very little of that force immigrates back into the apparatus 10. That which does is readily accommodated for by the structure including air bearing 80. Generally, when forming dot matrix type characters, for example ⅛th inch high with a 5×7 matrix, the system will form five to six characters per second. In a corresponding continuous mode, the apparatus 10 will form about two characters per second. Generally, with the arrangement of cabling and motor drive, the marker head 20 may be traversed at a maximum speed (without marking) of about 10 inches per second.

In accordance with the invention, the head 20 carrying steel marker pin 48 is formed of the above-described polyetherimide plastic. The relatively high strength and dimensional stability and self-lubricating features of this material provide for a substantial improvement in head performance. In this regard, the head 20 is light which complements the apparatus 10 and does not require an air drive system having an intermixed lubricant as has been required in all steel or aluminum and steel systems. FIG. 4 reveals the association of the head 20 with the manifold component 60 of marker base 90. The conduits formed in the manifold component 60 include the drive air conduit 310 which extends to solenoid actuated valve 72. From that solenoid actuated valve 72, a channel 312 extends to the piston chamber top of head 20 to provide downward marker pin drive. That same conduit also provides an exhaust function through the valve 72. Return air is introduced through conduit 314 which is seen to extend downwardly to the interface 316 between head 20 and manifold 60 in the same manner as conduit 312.

Figure 6:
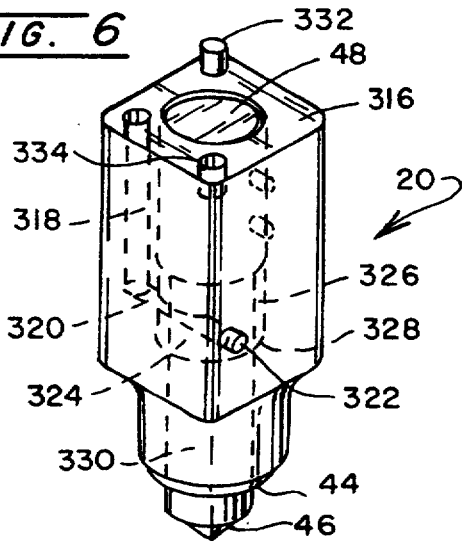
FIG. 6 is a perspective view of a marker head and associated marking pin structure according to the invention.

Looking to FIG. 6, the return air conduit component of head 20 is revealed as a bore 318 extending from a port at the interface 316. A counter-bore 320 which is plugged at 322 provides for the introduction of return air into the marker pin chamber 324. The chamber 324 includes a drive portion 326 extending from a top position at interface 316 to a seating surface 328. From the seating surface 328, the chamber 324 incorporates a shaft receiving portion 330 extending to the opening at confronting surface 44. Note that the return air bore 318 and counter-bore 320 are configured to introduce return air above the seating surface 328. To provide appropriate alignment between the head 20 and manifold component 60, an alignment pin 332 extends upwardly from the top surface of the head 20 at interface 316 and a bore 334 is provided for receiving a corresponding pin (not shown) mounted at the interface within manifold 60.

FIG. 5 reveals the hardened steel marker pin 48 to include an upwardly disposed piston portion 340 which is necked down to provide a lower annular surface 342 and having a shaft portion 344 which extends to provide the conical indentation tip 46. In the event of a "miss" wherein the marker pin 48 does not strike material but is driven freely downwardly by drive air, then the surface 342 may, depending upon the conditions at hand, impact upon the seating surface 328 to impose the highest reaction forces required to be accommodated by the apparatus 10. To assure that no damage is done under those conditions, the connector assemblies 64 and 66, which are implemented as draw latches, are configured so as to deform or break away. FIG. 5 further reveals an advantageous structuring of head 20 with respect to the operation of marker pin 48. In typical head structures, three regions are formed within the marker head, a piston chamber, a secondary chamber for developing a quantity of return air, and a cylindrical section for receiving the stem component of the marker pin. Head 20, however, is fashioned without the intermediary return air chamber and with the positioning of the return air outlet 320 above the seating surface 328. With that geometry, it is recognized that any return air which migrates upwardly around the piston 340 will be vented to atmosphere from the valve 72 and, thus, has no adverse effect. Marker pin 48 normally will have about a ¼ inch stroke and the lower surface 342 of piston portion 340 will not pass and block the conduit or port 320. However, in the event of a failure or pin "miss" where indentation tip 46 extends freely outwardly, then as the piston portion 340 passes and closes the port 320, a cushion of air will reside in the piston cavity adjacent the seating surface 328 which will tend to cushion the piston as it approaches that surface. The resultant high pressure is not visited upon the port 320-conduit 318, and associated return air system. Thus, the design provides improved pin protection while being more simple to fabricate. Electrical input connectors for coupling with the logic control associated with apparatus 10 are provided to the solenoid actuated valve 72 at terminals represented at 350 and 351 as seen in FIGS. 4 and 5. Additional control features associated with the remote logic system are revealed in FIG. 3 as home positioning detectors. In this regard, an opto-interruptor 52 is mounted upon port 40 and serves to provide an output condition when a downwardly depending flag 354 mounted upon translational bearing 150 slides within the exposed slots of the device. Similarly, an opto-interruptor 356 is mounted upon port 40 at a location wherein a downwardly depending flag 358 is detected as it passes through the central slot of device 356. Thus, a "home" signal is available to the control system for y-axis determination at bearing 150 and x-axis determination with respect to bearing 122.

Figure 7A:
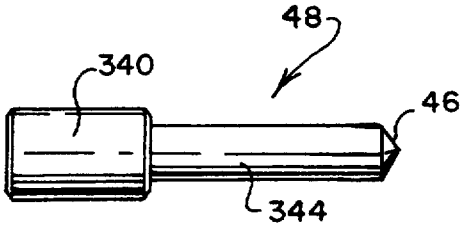
FIGS. 7A and 7B are side elevational views respectively showing a marker pin according to the invention and a marker pin representative of the prior art.
Figure 7B:
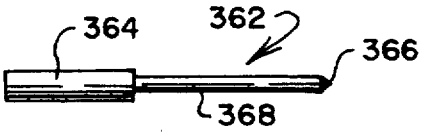
FIG. 7B PRIOR ART

As noted above, the quality of dot or indentation formation has been enhanced through the utilization of a polyetherimide material for head 20. Particularly for the single marker pin implementation represented in the apparatus 10, dot formation also can be improved with the pin structuring represented at 48. That pin 48 is again illustrated in FIG. 7A in comparison with smaller, conventional pins utilized in pin arrays as represented at FIG. 7B. In general, the force of a given impacting blow forming a dot is directly proportional to the mass of the pin. Thus by doubling the mass of the pin, a doubling of the force forming an indentation is achievable. By contrast, where the speed of the pin is increased, then the resultant force is increased in proportion with the square of that speed. Thus, optimization evaluations can be made to an extent, however, these optimizations become empirical quickly in the course of analysis. With respect to the pin 48, it has been found that speed increase, as predicated upon the diameter of the pin piston at 340, is substantially improved to improve marking where that diameter is at least about 06.2 inch (1.59 cm). Contrasting the piston component with a conventional array type pin represented at 362, the diameter of the piston portion 364 is 0.187 inch (0.47 cm). That lower diameter was earlier selected to achieve a closely nested pin array as opposed to a single pin. The mass of pin 48 as shown at FIG. 7A has been found to be empirically desirable when it is greater than about 50 gm. The corresponding mass of pin 362 as shown in FIG. 7B is about 4 gm. For each of the pins 48 and 362 as illustrated, the conical tip portions 46 and 366 have a 30° bevel. Those bevels can vary, for example, to 45° depending on the form of dot desired. Note additionally that the diameter of the shaft 344 of pin 348 is relatively thicker in keeping with the noted mass values and practical requirements for strength. That diameter, for example, is about 0.37 inch (0.94 cm). Correspondingly, the diameter of shaft 368 of pin 362 is about 0.09 inch. (0.22 cm)

Control over the apparatus 10 from a logic and electronic standpoint is carried out by a separately-located controller which, preferably, may be integrated with a custom keyboard. That keyboard may be quite similar to a conventional personal computer keyboard. The controller functions for the control system are somewhat conventional including a central processing unit (CPU) logic section, an input/output (I/O) section, a power supply section, battery back-up and a motor interface and driver section along with a driver function for operating the solenoid-actuated valve 72.

Figure 8:
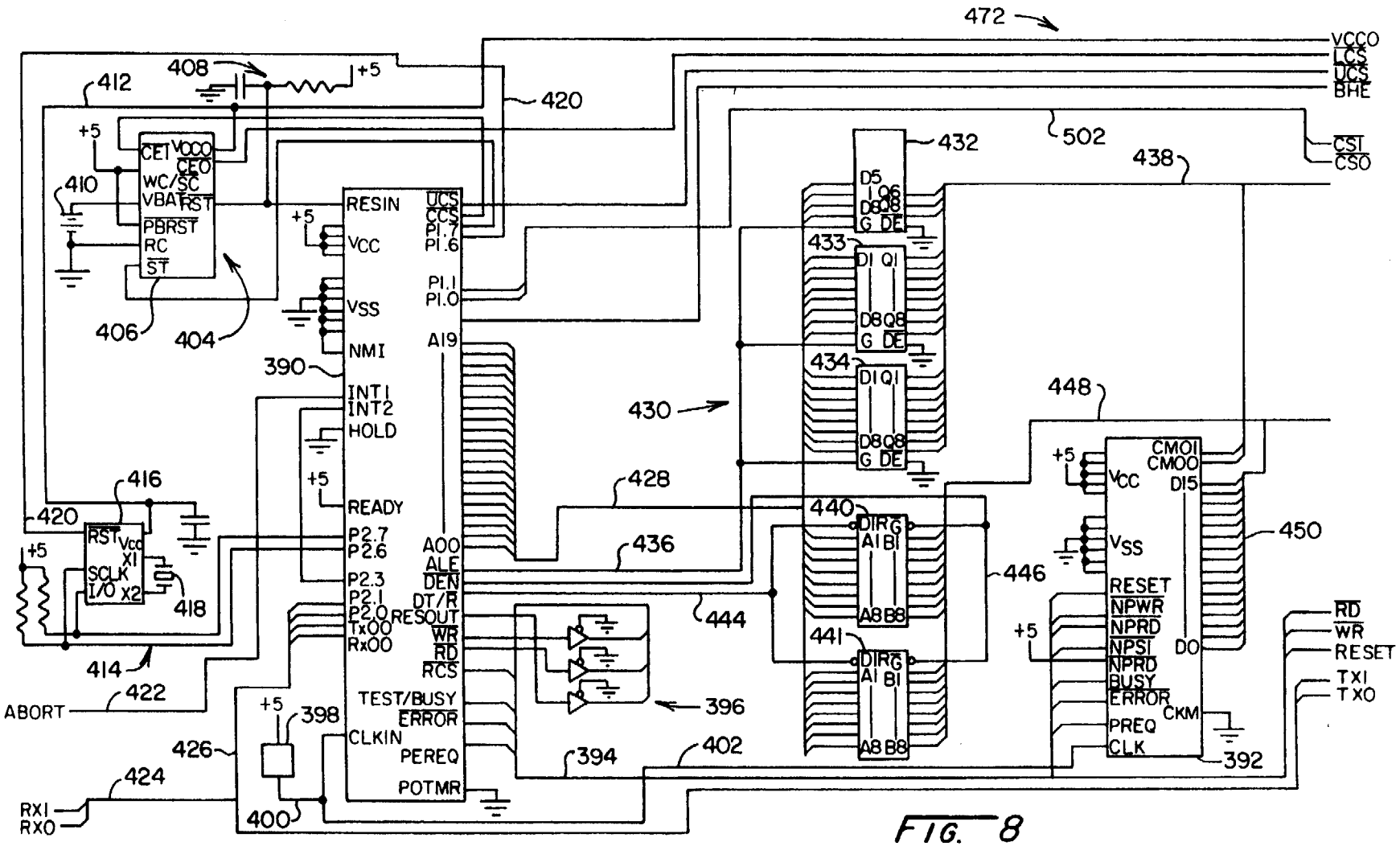
FIG. 8 is an electrical schematic diagram of the central processing unit and co-processor components of control circuitry employed with the invention.

Referring to FIG. 8, the apparatus 10 performs in conjunction with a central processing unit (CPU) 390 which, for example, may be provided as an 80C186DB microprocessor marketed by Intel Corp. Device 390 includes such features as two independent UARTs, two 8-bit multiplex I/O ports, a programmable interrupt controller, and three programmable 16-bit timer/counters. Additionally, the device incorporates a clock generator, 10 programmable chip select functions with integral wait-state generator, a memory refresh control unit and system level testing support. Device 390 performs in conjunction with a math coprocessor 392. Coprocessor 392 may, for example, be provided as a type 80C187 80-bit math coprocessor marketed by Intel Corp, which directly interfaces with device 390. In the latter regard, control interfacing between these two devices is provided from bus 394 which provides reset out, read and write outputs which are buffered at buffer array 396 for presentation via leads of bus 394 to corresponding inputs at device 392. Other controls from device 390 as labeled NCS, test/busy, error, and PEREQ also are asserted to corresponding inputs at device 392 via bus 394, while a clock input as generated from clock 398 and lines 400 and 402 provides that function to both devices 390 and 392. The clock frequency evoked from device 398 is at 32 MHz. A power monitoring function is provided at network 404. Network 404 incorporates a type DS1236 "Micro Manager Chip" 406 which may be provided, for example, as a type DS 1236 marketed by Dallas Semiconductor, Inc. Device 406 as configured within network 404 provides for reset control, memory back-up, and the like. Its RSD terminal is seen coupled both with the RESIN input to CPU 390 as well as to an RC network 408. Battery input to device 406 is provided in conjunction with battery 410, the terminals of which are coupled to the bat and RC inputs to the devices. Line 412 from the network 404 also is seen to extend to a time/date network 414 which includes a serial time-keeping chip 416. Device 416 as coupled with an oscillator 420, receives a Vcc input from line 412 and a reset input from line 418 extending to the P1.6 terminal of CPU 390. Inputs from network 414 are to the P2.6 and P2.7 terminals of CPU 390. Additionally asserted from an external source to device 390 is an abort signal from line 422 and serial interface receiving data from two lead bus component 424 as well as corresponding transmit signals labeled TX1 and TX0 via combined bus components 426.

Terminals AD0–AD19 of device 390 are coupled with address bus 428 which is seen to extend to a bus interface function represented generally at 430 and including bus decoders 432–434 which are selectively enabled from the ALE terminal of device 390 as represented by line pattern 436. The outputs of decoders 432–434 are provided at address bus 438. Devices 432–434 may be provided, for example, as type 74ALS573 components.

Bus 428 also extends to data bus latches 440 and 441, the data directional control of which is asserted from device 390 via line pattern 444. Devices 440 and 441 may be provided, for example, as type 54HC245 octal buffers with three-state outputs, marketed by Texas Instruments, Inc. and are designed for asynchronous two-way communication between data buses. The G terminal components of the devices are coupled with device 390 via line pattern 446 and the B1–B8 terminals thereof are coupled with data bus component 448. This data bus also is seen directed as represented at branch 450 as being directed to the D0–D15 inputs to math coprocessor 392.

Figure 9:
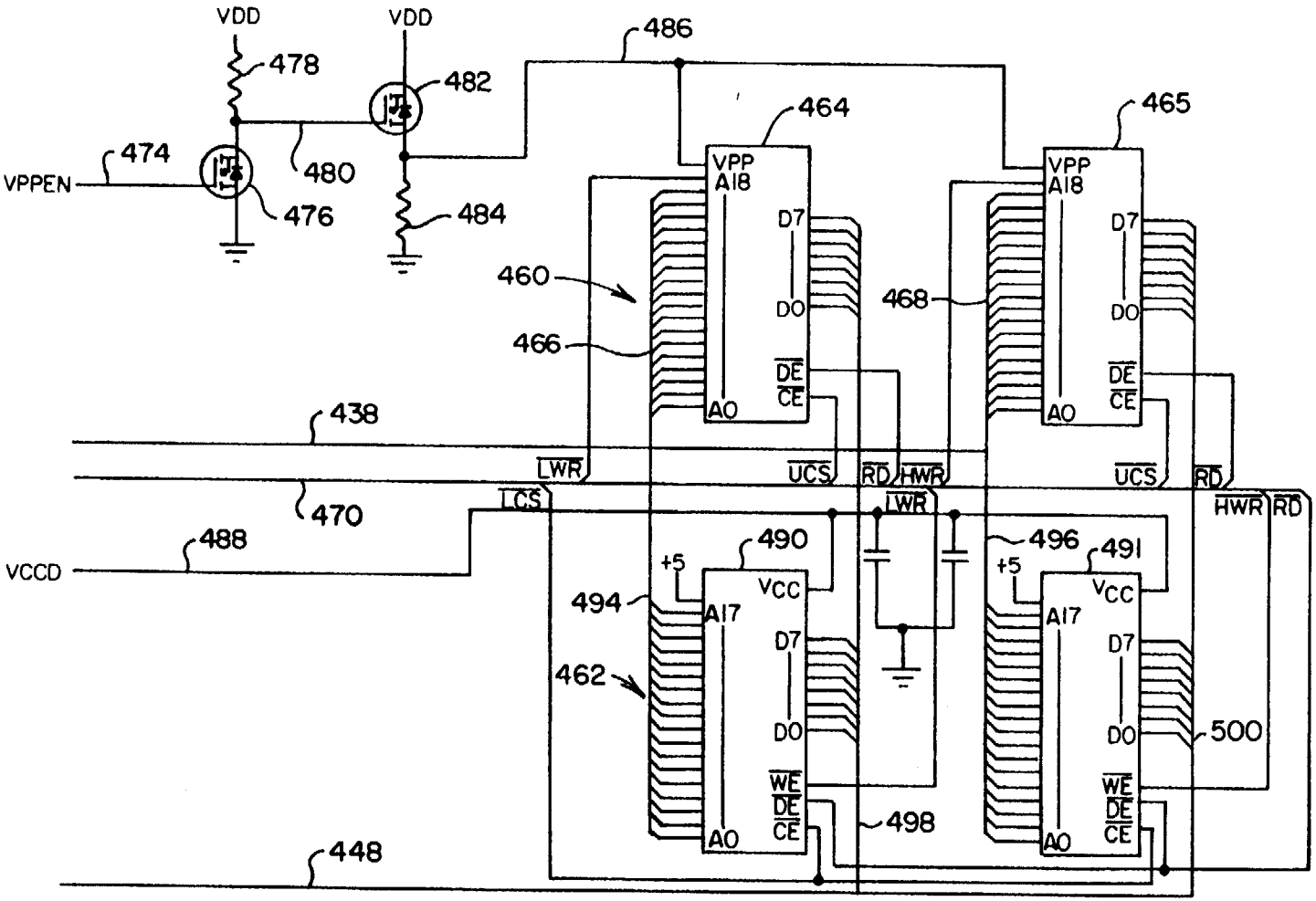
FIG. 9 is an electrical schematic diagram showing memory components employed with the processing features of FIG. 8.

Turning to FIG. 9, the memory section of control function is revealed. This memory section includes an erasable, programmable read only memory (EPROM) component grouping 460 and a static random access memory (SRAM) device grouping 462. The EPROM components at 460 include two 128K–256K×8 devices 464 and 465. While EPROM components are shown, flash memory devices are preferred for the function at hand because of their improved facility in accommodating software upgrades. One type of flash memory which may be employed at devices 464 and 465 is a type 28F010 1024K CmOS flash memory marketed by Intel, Inc. Lead components A1–A18 from address bus 438 (FIG. 8) are asserted via bus lines 466 and 468 to respective devices 464 and 465 when implemented as flash memory devices. Control input to memory components 464 and 465 are derived from bus 470 which includes the $\overline{RD}$, and $\overline{WR}$ components of bus 394 (FIG. 8) as well as the $\overline{LCS}$, $\overline{UCS}$ and $\overline{BHE}$ signal leads from lead grouping 472 shown in FIG. 8. Where the devices 466 and 468 are implemented as flash ROM, then a programming enablement can be provided to them as presented at line 474 and labeled VPPEN. This signal emanates from an interface device and is presented to the gate of an N channel field effect transistor (FET) 476. The source terminal of device 476 is coupled through a resistor 478 to +12 v while the drain terminal thereof is coupled to ground. The same source terminal also is coupled via line 480 to the gate of an N channel FET 482, the source terminal of which is coupled to +12 v and the drain terminal of which is coupled through resistor 484 to ground. That same terminal also is coupled to the VPP terminals of devices 464 and 465 via line pattern 486. With the arrangement shown, where a logic high signal is presented at line 474, FET 476 is turned on to, in turn, draw FET 482 into conduction. This provides a high level +12 v at line 486 functioning to permit the programming of devices 464 and 465. Conversely, without the appropriate signal at line 474, the low or ground approaching voltage at line 486 prohibits an inadvertent writing to those devices.

Looking to the random access memory function 462, it may be observed that the VCCO signal from power monitor device 406 (FIG. 8) is directed from line grouping 472 and is identified in FIG. 9 as line 488. This power input extends to the Vcc inputs of the static RAM devices of function 462 as identified at 490 and 491. The A0–A17 terminals of device 490 are coupled to address bus component 438 as represented at 494 while a corresponding connection is made with device 491 from bus component 496. Data bus association with to devices 490 and 491 is derived from bus 448 as described in conjunction with FIG. 8 and is seen extending from that bus as represented at bus lines 498 and 500, not only to the D0–D7 terminals of respective devices 491, but also to the correspondingly labeled terminals of EPROM devices 464 and 465. Chip select read and write inputs to devices 490 and 491 are provided from bus component 470 carrying the $\overline{LCS}$, $\overline{LWR}$, $\overline{HWR}$, and $\overline{RD}$ signals. (One type of flash memory which may be employed at devices 464 and 465 is a type 28F010 1024K CMOS flash memory marketed by Intel, Inc.)

Figure 10:
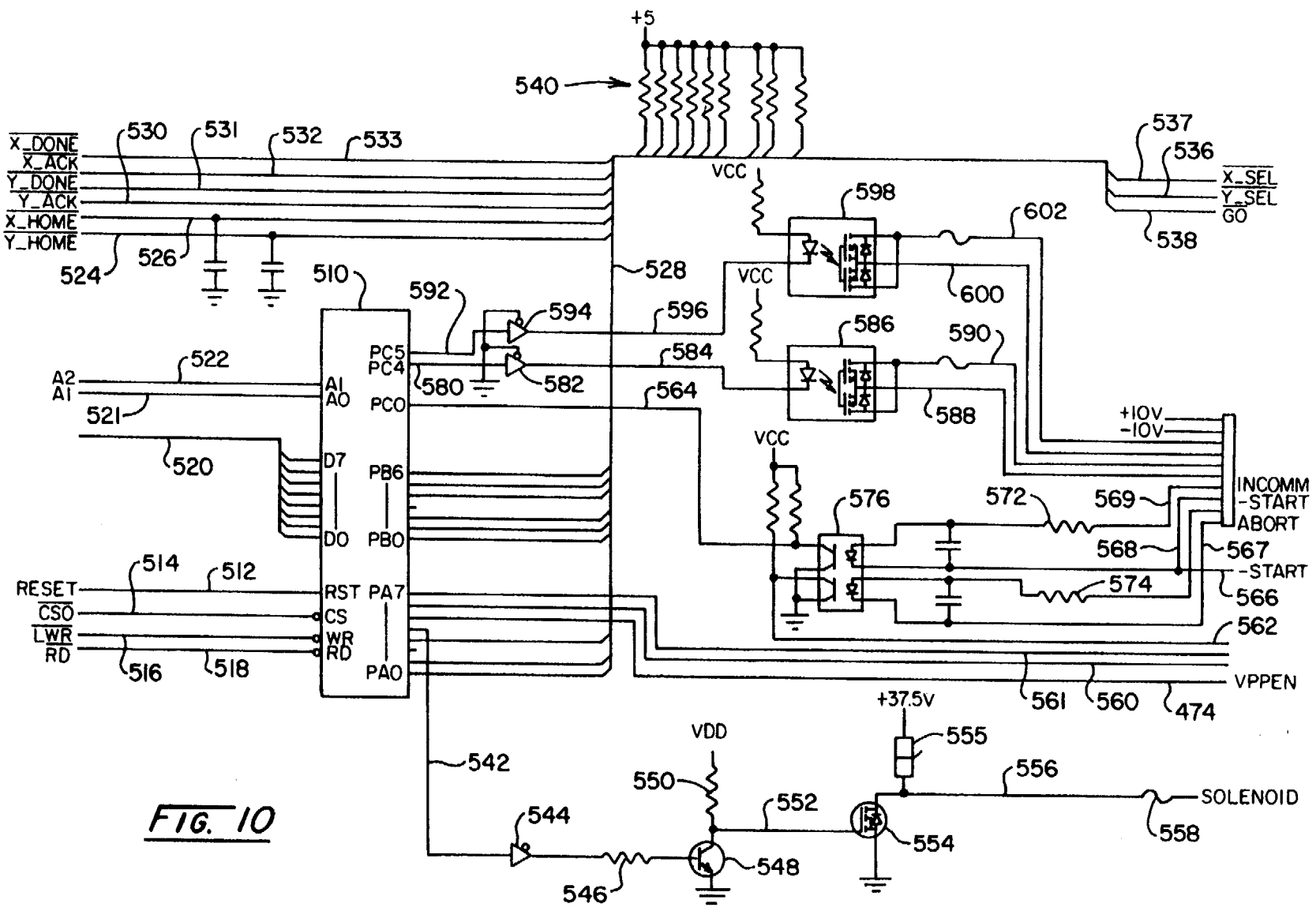
FIG. 10 is an electrical schematic diagram showing input/output functions of the control arrangement employed with the invention.

Referring to FIG. 10, the input/output (I/O) section of the control features is revealed. This section utilizes I/O input/output chip or integrated circuit 510 which may be provided, for example, as a type 8255 marketed by Intel, Inc. The reset (RST) terminal of device 510 receives a reset signal from the CPU 390 (FIG. 8) as described in conjunction with bus 394 and as represented in the instant figure at line 512. Similarly, the CSO chip select input to device 510 is provided at line 514 which is derived from two lead bus 502 in FIG. 8 extending, in turn, to the P1.0 and P1.1 terminals of CPU 390. The write (WR) terminal of device 510 receives and $\overline{LWR}$ signal from line 516 which is derived from a programmable array logic device described in conjunction with FIG. 11. Correspondingly, the read (RD) terminal of device 10 receives a $\overline{RD}$ signal at line 518 as one lead from bus 394 is developed from buffer network 396 as described in conjunction with FIG. 8. Data inputs D0–D7 are provided as a portion of earlier-described bus 448 and now identified at 520, while signals A1 and A2 as seen at respective lines 520 and 522 extend from address bus 438 (FIG. 8) to respective terminals A0 and A1 of device 510. Ports PA0–PA7 and PB0–PB7 of the device 510 perform, inter alia, in a handshaking fashion with the motor drive features of the control system. In this regard, ports PB0 and PB1 carry $\overline{Y_ACK}$ and $\overline{Y_DONE}$ signals. Terminals PB4 and PB5 carry signals represented as $\overline{X_ACK}$ and $\overline{X_DONE}$ signals. Ports PB2 and PB6 respond to $\overline{Y_HOME}$ and $\overline{X_HOME}$. These signals, respectively, are developed at capacitor filtered lines 524 and 526 which extend to the bus 528. The hand-shaking signals emanating from terminals PB0, PB1, PB4, and PB5 are seen to correspondingly extend to respective lines 530–533 which reappear at the motor control function. Terminals PA0, PA1 and PA3 of device 510 provide outputs respectively carrying the signals $\overline{Y_SEL}$, $\overline{X_SEL}$ and $\overline{GO}$ which are presented at bus 528 as well as are seen at respective lines 536–538 which extend to the motor drive and control function. All of the above nine signals are coupled through an appropriate resistor to +5 v at pull-up resistor array 540.

The solenoid component of solenoid valve 72 is selectively energized by a signal presented from device 510 at terminal PA4 thereof and presented at line 542 to the input of buffer 544 to provide additional drive current. The signal then is presented through base resistor 546 to the base of NPN transistor 548, the emitter of which is coupled to ground and the base of which is coupled to voltage supply through resistor 550 to +12 v supply. Thus, transistor 548 performs as a level shifter and inverter. The collector side of transistor 548 is coupled via line 552 to the gate of FET transistor 554, the source of which is coupled to line 556 and +37.5 v power supply and through fuse 558 to a solenoid coupling connector, while the drain of device 554 is coupled to ground. With the arrangement shown, a logic high value at line 542 is level shifted at non-inverting buffer 544 to turn on transistor 548 to, in turn, turn off transistor 554. As a consequence, there is no solenoid drive current at line 556. Correspondingly, a logic low signal turns off transistor 548, to, in turn, turn on transistor 554 and provide solenoid drive current. Metal oxide varistor (MOV) device 555 provides protection against inductive spike efforts occasioned by the turning off of solenoid drive.

Returning to device 510, terminal PA5 carries the VPPEN programming signal earlier described at line 574 in connection with FIG. 9. Terminals PA5 and PA6, respectively, carry signals $\overline{TX_ENA}$ and $\overline{RX_ENA}$ as outputs at respective lines 561 and 560 to serial communications to the system as described in connection with FIG. 12 and line 562 to terminal PA7 carries an $\overline{ABORT}$ signal witnessed in FIG. 11.

Terminal PC0 of device 510 receives either a start or an abort signal from line 564 which are developed externally as represented at lines 566–569 as labeled and presented through current limiting resistors 572 and 574 to the inputs of a dual, a.c. opto-coupler 576. Device 576 may be provided, for example, as a type ILD620GB marketed by Seimens Corp.

Outputs from device 510 which are supplied to the operator at a terminal or the like, for example, indicating a done or ready condition, may be provided from ports PC4 and PC5. A ready signal is generated from terminal PC4 and presented at line 580. That signal is buffered at buffer 582 and presented as a low true signal through line 584 to an opto-isolator 586. The resultant ready signals then are presented at lines 588 and 590.

Similarly, a done signal presented at terminal PC5 of device 510 is developed at line 592 whereupon it is buffered at buffer stage 594 and presented at line 596 to the input of opto-isolator 598. The resultant isolated ready signal then is provided at lines 600 and 602. Devices 586 and 598 may be provided, for example, as photo MOS relays type AQV251 marketed by Aromat Corp.

Figure 11:
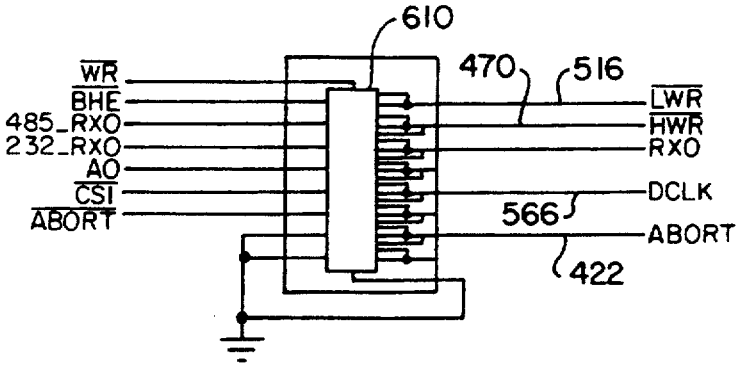
FIG. 11 is an electrical schematic diagram of a programmable logic device employed with the control arrangement utilized with the invention.

Looking momentarily to FIG. 11, a programmable array logic device is shown at 610 which responds to $\overline{WR}$, $\overline{BHE}$, $\overline{A0}$, and $\overline{CS1}$ inputs from CPU 390 as described in conjunction with FIG. 8. Additionally, device 610 responds to an $\overline{ABORT}$ output from I/O device 510 (FIG. 10) at line 562 and to communications signals described in conjunction with FIG. 12. The device 610 is programmable utilizing Boolean logic to derive corresponding $\overline{LWR}$ and $\overline{HWR}$ signals providing for memory controls described in conjunction with FIG. 9 and bus 470. A resultant RX0 signal is provided to CPU 390 at line 424 described in conjunction with FIG. 8, while a generated OCLK signal is developed for memory control described in conjunction with FIG. 13. Finally, an abort signal is generated for presentation at line 422 as described in conjunction with FIG. 8.

Figure 12:
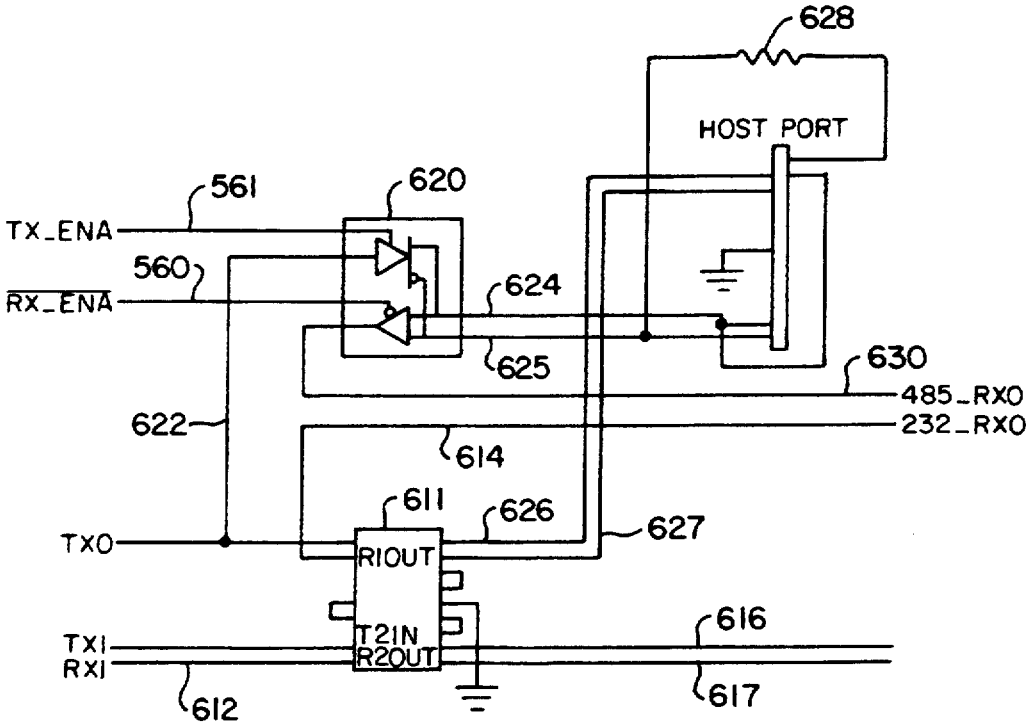
FIG. 12 is an electrical schematic diagram showing communications components employed with the control features utilized with the invention.

Turning to FIG. 12, the serial interface components of the apparatus 10 are revealed. This interface includes RS-485 and RS-232 drivers. In this regard, device 611 is an RS-232 driver and may be provided, for example, as a type MAX233. Device 611 receives the earlier-described TX1 signal from CPU 390 (FIG. 8) as described in connection with bus 426 as well as a TXZ0 from that same bus. Driver 611 provides an output to bus 424 and CPU 390 as represented at line 612. A further output is developed from device 611's R1OUT terminal at line 614 which carries the earlier-noted signal identified as 232-RX0 which is submitted to PAL device 611 as described in conjunction with FIG. 11. Finally, device 611 provides respective outputs and receives inputs from lines 616 and 617 which are connected to a local port such as an internal keyboard or external keyboard or terminal.

The RS-485 driver is shown at 620 which receives $\overline{TX_ENA}$ and $\overline{RX_ENA}$ signals from earlier-described lines 561 and 560 described in connection with FIG. 10. Additionally, the device receives a TXO signal as similarly submitted to device 611 from line 622. The communications lines for device 620 are at lines 624 and 625 and, in conjunction with lines 626 and 627 as well as a terminating resistor configuration 628, provide communication of RS-232 or RS-485 variety for a host port. Finally, line 630 provides the earlier-noted 485-RXO signal which is introduced to PAL device 610 as described in conjunction with FIG. 11.

Figure 13:
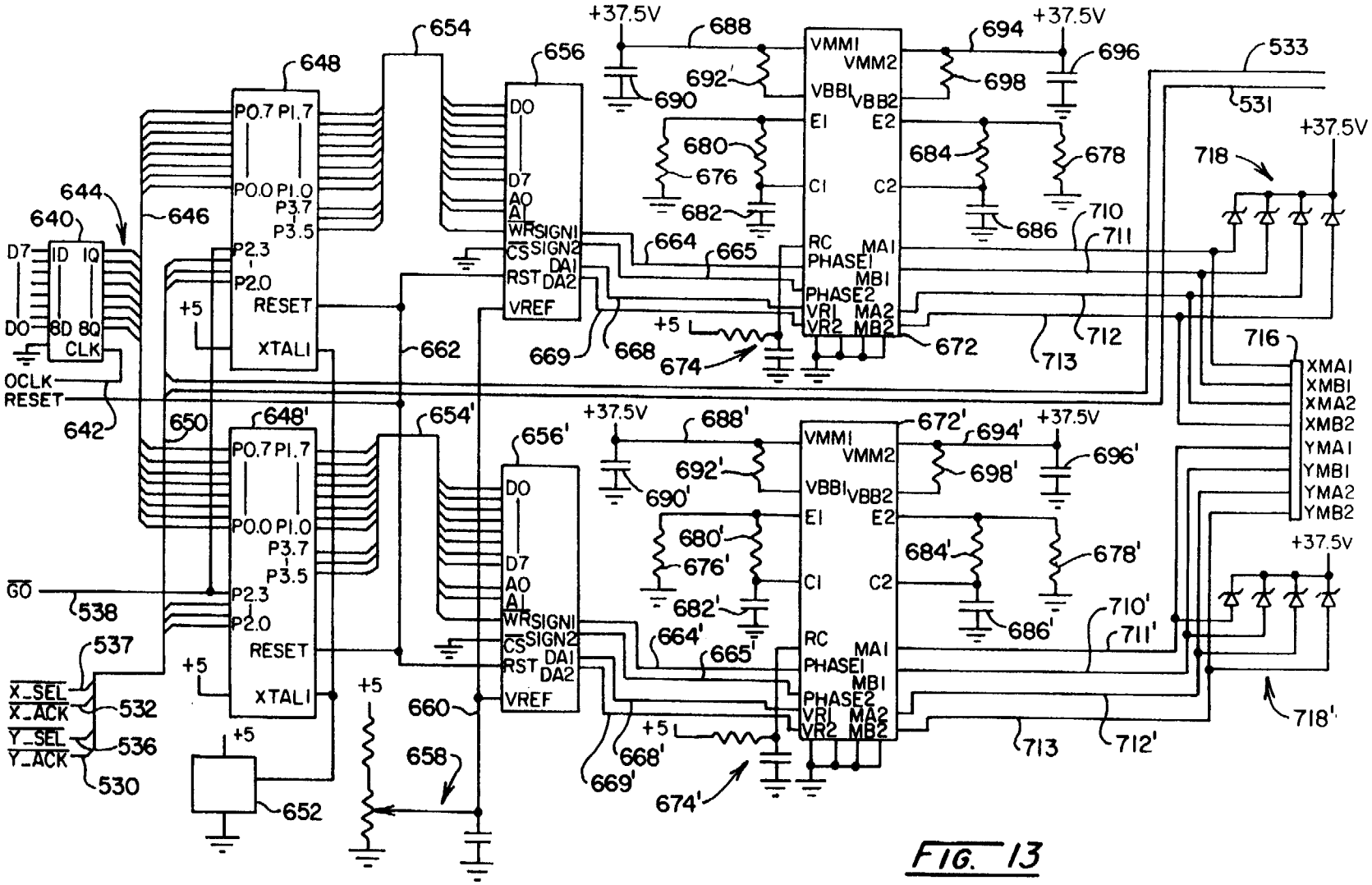
FIG. 13 is an electrical schematic diagram showing separate motor control features employed with the control system utilized with the invention.

Referring to FIG. 13, the controller for driving stepper motors 210 and 216 as well as interfacing the controller to CPU 390 is illustrated. The D0–D7 data bus 448 components from CPU 390 are directed to the 1D–8D terminals of a data latch 640, the clock input to which receives the OCLK signal from line 642 earlier identified as an output of PAL 610 (FIG. 11). The output of device 640 at array 644 is provided to a bus 646 which extends to the input P0.0–P0.7 ports of a controller 648. Controller 648 may, for example, be a type 87C51 marketed by Intel Corp. The same data inputs are provided from bus 646 to an identical controller providing for y-coordinate stepper motor control. Because the x-coordinate and y-coordinate components of the circuit of FIG. 13 are identical, the x-coordinate components are described and those y-coordinate components which correspond to the x-coordinate components are identified with the same numeration but in primed fashion. Accordingly, the y-coordinate controller is identified at 648'. Controller 648 additionally receives the $\overline{X_DONE}$, $\overline{X_ACK}$, and $\overline{X_SEL}$ handshake signals from bus 650 as described, inter alia, in conjunction with the handshaking functions of I/O device 510 (FIG. 10). Controller 648 receives the corresponding y-coordinate signals $\overline{Y_DONE}$, $\overline{Y_ACK}$ and $\overline{Y_SEL}$. Of the above signals, those representing done and acknowledged are outputs and those representing a select function are inputs. Devices 648 and 648' additionally receive a $\overline{GO}$ signal as generated at I/O device 510 in conjunction with line 538 which is reproduced in the instant figure. Finally, a clock drive is provided to the XTAL1 terminals of both devices 648 and 648' from a clock pulse generator 652.

Controller 648 is interfaced via its P1.0–P1.70 terminals and its P3.5–P3.7 terminals and bus 654 to corresponding terminals D0–D7, A0, A1, and $\overline{WR}$ terminals of a microstepping controller/dual digital-to-analog converter 656. Provided, for example, as a type PBM3960 marketed by Ericsson Corp., the device 656 is a dual seven-bit+sign, digital-to-analog converter (DAC) which performs in conjunction with a stepper motor driver for microstepping applications. The device performs in conjunction with a voltage reference developed from a voltage reference network 658 which provides a voltage reference input at its VREF terminal from line pattern 660. Both components 656 and 648 may be reset from line pattern 662 which carries a signal generated from CPU 390 as described earlier in conjunction with bus 394.

Device 656 provides two sign or directional outputs at lines 664 and 665 as well as two voltage level outputs as presented at lines 668 and 669.

Lines 664 and 665 are directed to the PHASE 1 and PHASE 2 terminals of a dual stepper phase, constant current source driver 672. Device 672 may be provided, for example, as a type PBL3775 dual stepper motor driver marketed by Ericsson Corp. In addition to the phase inputs, the voltage inputs from lines 668 and 669 are directed, respectively, to the BR1 and BR2 terminals of device 672. An RC network 674 having an output coupled to the RC terminal of device 672 provides for a drive clock frequency, for example, of about 27 KHz.

Current is sensed for PHASE 1 of a given motor by a resistor 676 while the current the second motor phase is sensed at corresponding resistor 678 coupled to terminal E2. Resistor 680 and capacitor 682 provide a form of low pass filter for connection to terminals C1 which represents a comparator input which is compared to the reference input at terminal RC to develop control functions. Similarly, resistor 684 and capacitor 686 provide the same function in connection with the second phase control of the associated stepper motor. High voltage input, i.e. +37.5 v is provided to the VMM1 and VBB1 terminals of device 672 in conjunction with line 688, capacitor 690, and resistor 692. Correspondingly, the same voltage is applied via line 694, capacitor 696, and resistor 698 to the VMM2 and VBB2 terminals of device 672 for the second phase control of the associated stepper motor.

The output from driver 672 is provided at its terminals MA1, MB1, MA2, and MB2 which are presented, respectively, at lines 710–713 to be provided as the input connection to the stepper motors at connector 716. To accommodate for inductive spike level control, an array of protection diodes 718 is operationally associated with lines 710–713.

Figure 14:
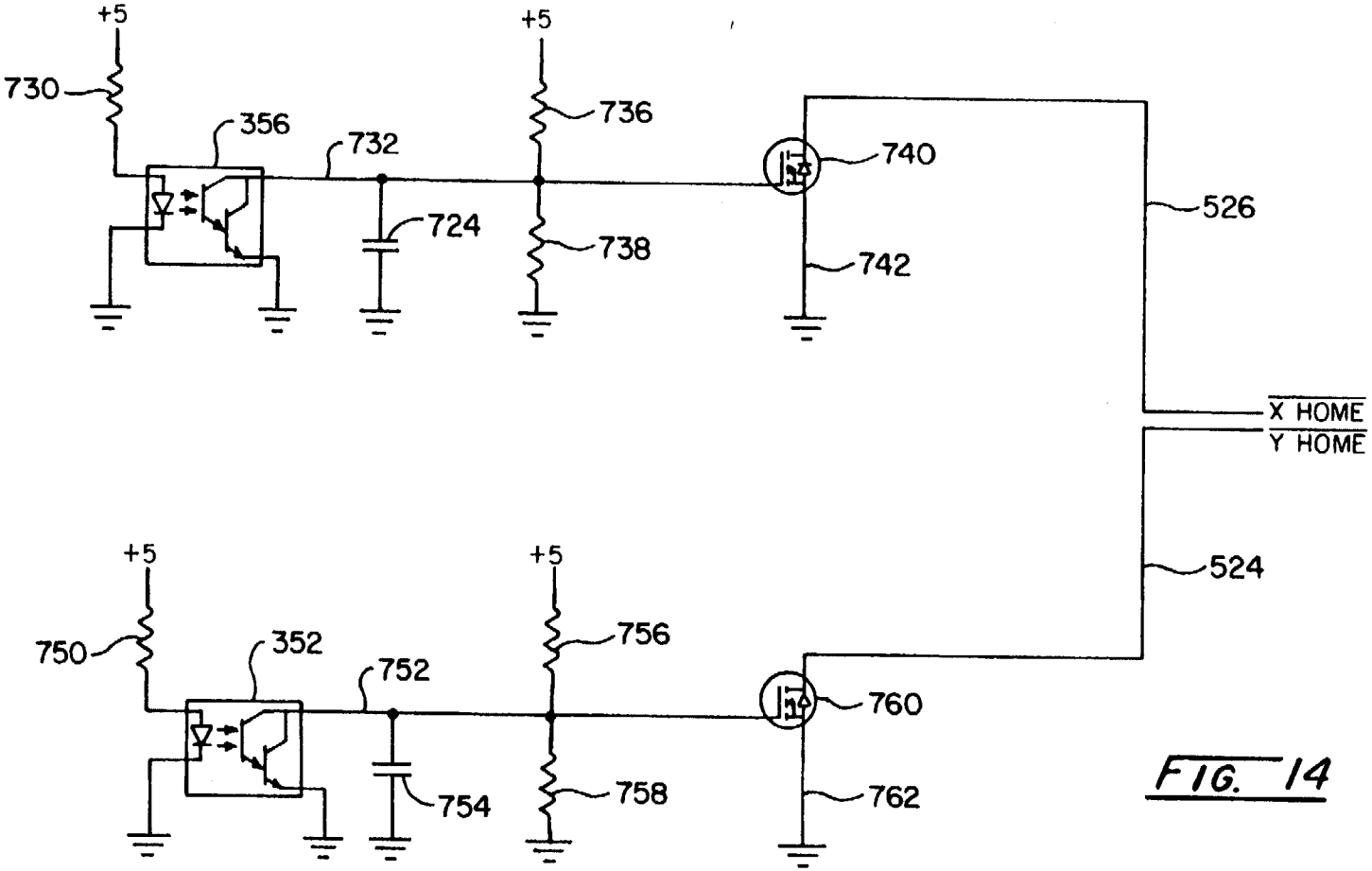
FIG. 14 is an electrical schematic diagram showing electro-optical devices for detecting home positions of coordinate drives employed with the invention.

Referring to FIG. 14, the x-coordinate home sensor and y-coordinate home sensor described in conjunction with FIG. 3 are portrayed in schematic detail. Home sensor 356 representing x-coordinate home data is again represented by numeral 356. The device includes an I/R emitting diode which is normally on by virtue of +5 v bias supplied through resistor 730 to the emitting diode anode while the cathode thereof is coupled to ground. A Darlington coupled photo-transistor pair responds to that illumination to provide an open collector output at line 732 which is filtered at capacitor C34. Additionally, resistors 736 and 738 coupled between +5 v and ground and to line 732 to provide a bias at the gate of FET transistor 740. The drain of device 740 is coupled to ground through line 742, while the source thereof is coupled to line 744 and, depending upon the positioning of flag 358 within the gap of device 356, provides or does not provide the $\overline{\text{X_HOME}}$ signal at earlier-described line 526 described in conjunction with FIG. 10 and shown with the same numeration in the instant figure. With the arrangement shown, when flag 358 is not obstructing the gap between the diode and photo-transistors of device 356, the transistor pair are turned on to provide a low voltage or low logic level at line 732 providing that transistor 740 is turned off. When the flag is obstructing, transistor 740 is turned on.

In similar fashion, the $\overline{\text{Y_HOME}}$ sensor earlier-described at 352 in conjunction with FIG. 3 is identified by the same numeration in FIG. 14. As before, an I/R emitting diode is biased to an on state from +5 v through resistor 750. This diode emits I/R radiation across a gap to Darlington paired photo-transistors having an output at line 752 which is filtered by capacitor 754. A resistor pair 756 and 758 coupled between +5 v and ground as well as to line 752 provides gate bias to an FET transistor 760, the drain terminal of which is coupled to line 524 as described earlier in connection with FIG. 10 and the source terminal of which is coupled via line 762 to ground. Thus configured, the network provides or does not provide the $\overline{\text{Y_HOME}}$ signal at line 524 depending upon the presence or non-presence of flag 354 within the gap of device 352 in the same fashion as provided in connection with device 356.

Figure 15:
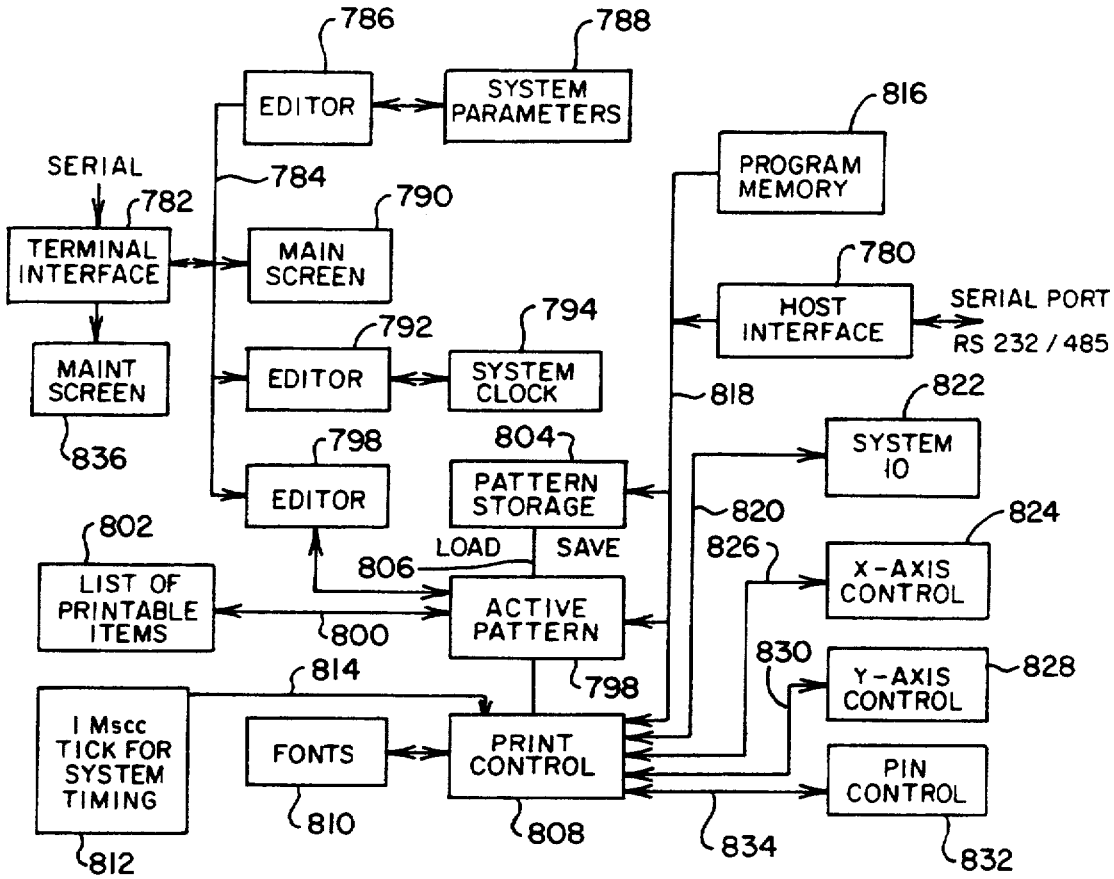
FIG. 15 is a block schematic representation of a software-based control which may be employed with the invention.

Referring to FIG. 15, a block diagrammatic representation of the software program with which the apparatus 10 may perform is provided. Similar software is described, for example, in detail in U.S. Pat. No. 5,316,397 entitled "Marking Apparatus with Multiple Marking Modes" by Robertson, et al., issued May 31, 1994, and assigned in common herewith. Additionally, such software is marketed under the trade designation "TMP 6000" by Telesis Marking Systems, Inc. of Circleville, Ohio Locking to FIG. 15, two serial ports perform with the apparatus 10, one a host interface as represented at block 780 which performs in serial port RS232/485 fashion. Additionally, access to the program is from a terminal, either dedicated or through a personal computer. The terminal interface is represented at block 782 and is seen to perform in an operator interaction mode with, as represented by line 784, an editor for editing system parameters as represented at blocks 786 and 788. Additionally, as represented at block 790, the main screen will provide interactive visual information to the operator. Blocks 792 and 794 provide for the editing of the system clock, for example, adjusting time of day and day of the month. Next, as represented at blocks 796 and 798, the operator has the capability for editing the active pattern. Pattern in this regard contains a list of printable items, for example, most predominantly a text field. Other patterns may include art or logos and the like. Such a list of printable items associated with the pattern is represented by line 800 and block 802. Only an active pattern is capable of being edited with the system and thus the association of the active pattern function at block 798 with a pattern storage function is represented at block 804 and line 806. The active pattern function as represented at block 798 performs in conjunction with a print control function as represented at block 808 which accesses the active pattern as well as associated fonts as represented at block 810. Additionally, a one millisecond tick may be accessed for system timing as represented at block 812 and line 814.

The program memory is represented at block 816 and, where flash memory is employed as described above, then the program may be altered by the user from a terminal. Host interface block 780 is seen accessing the pattern storage, the active pattern storage represented at block 804, the active pattern represented at block 798, and print controls represented at block 808 from line 818. In similar fashion, the system input/output function performs in conjunction with the print control represented at block 808 as depicted by line 820 and block 822. x-axis control is represented in the figure at block 824 as communicating with print control function 808 by line 826. The corresponding y-axis control represented at block 828 is in communication with the print control function 808 as represented by line 830 and the pin control feature as represented at block 832 is in interactive association with the print control function at block 808 as represented by line 834.

As represented at block 836, the terminal interface represented at block 782 also may perform in conjunction with a maintenance screen which permits the operator to test the system, for example, test the marker function by pulsing the marker pin and the like.

Since certain changes may be made in the above apparatus without departing from the scope of the invention herein involved, it is intended that all matter contained in the above description or shown in the accompanying drawings shall be interpreted as illustrative and not in a limiting sense.

We claim:

1. Apparatus for marking a surface of an object with a marking device in response to control inputs, comprising:

a support member positionable in spaced adjacency with said object surface and having a flat platen surface extending between field support defining peripheries;

a first cross bar assembly located a first predetermined distance outwardly from said platen surface, and extending between first and second said peripheries;

a first bearing assembly coupled with and supporting said first cross bar assembly at said first predetermined distance and adjacent first and second ones of said peripheries and drivable to move said first cross bar assembly in a first coordinate sense:

a second cross bar assembly located a second predetermined distance outwardly from said platen surface and extending between third and fourth ones of said peripheries:

a second bearing assembly coupled with and supporting said second cross bar assembly at said second predetermined distance and adjacent said third and fourth peripheries, and drivable to move said second cross bar assembly in a second coordinate sense;

a motor assembly coupled in driving relationship with said first and second bearing assemblies for effecting the movement thereof in response to said control inputs;

a marker base having a first channel defining portion extending therethrough and slidably engaging said first cross bar assembly, having a second channel defining portion extending therethrough and slidably engaging said second cross bar assembly, said marker base having an inwardly disposed portion in spaced adjacency with said platen surface and an oppositely disposed marker support portion for supporting a said marking device, and drivably movable by said first and second cross bar assemblies in said first and second coordinate senses; and an air bearing, having a center, located intermediate said marker base inwardly disposed portion and said platen surface, having an air expressing bearing surface air supportable over said platen surface, movable with and coupled in force transfer relationship with said marker base.

2. The apparatus of claim 1 in which said motor assembly comprises:

a first motor fixed to said support member and having a rotational output;

a first drive assembly connected in driven relationship with said first motor output and in driving relationship with said first bearing assembly;

a second motor fixed to said support member and having a rotational output; and a second drive assembly connected in driven relationship with said second motor output and in driving relationship with said first bearing assembly.

3. The apparatus of claim 2 in which said first bearing assembly comprises:

a first translational bearing mounted upon said support member, and coupled with said first drive assembly for driven movement between termini along a first linear locus of travel adjacent said first periphery; and a second translational bearing mounted upon said support member and coupled with said first drive assembly for driven movement between termini along a second linear locus of travel adjacent said second periphery.

4. The apparatus of claim 3 in which said second bearing assembly comprises:

a third translational bearing mounted upon said support member and coupled with said second drive assembly for driven movement between termini along a third linear locus of travel adjacent said third periphery; and a fourth translational bearing mounted upon said support member and coupled with said second drive assembly for driven movement between termini along a fourth linear locus of travel adjacent said fourth periphery.

5. The apparatus of claim 3 in which said first drive assembly comprises a flexible cable connected with said first motor rotational output and said first and second translational bearings.

6. The apparatus of claim 5 in which said second drive assembly comprises a flexible cable connected with said second motor rotational output and said third and fourth translational bearings.

7. The apparatus of claim 3 in which:

said first motor includes a capstan rotatable as said rotational output; and said first drive assembly comprises:

first and second pulleys, each being mounted upon said support member adjacent one said terminus of said first linear locus of travel and each being freely rotatable about a given axis, third and fourth pulleys, each being mounted upon said support member adjacent one said terminus of said second linear locus of travel and each being freely rotatable about a given axis, a flexible cable having a predetermined length thereof wound in driven relationship about said first motor capstan and extending about said first pulley to a connection with said first translational bearing and extending about said fourth pulley to a connection with said second translational bearing.

8. The apparatus of claim 7 including a first follower flexible cable extending about said second pulley to a connection with said first translational bearing and extending about said third pulley to a connection with said second translational bearing.

9. The apparatus of claim 7 in which:

said second motor includes a capstan rotatable as said rotational output; and said second drive assembly comprises:

fifth and sixth pulleys, each being mounted upon said support member adjacent one said terminus of said third linear locus of travel and each being freely rotatable about a given axis, seventh and eighth pulleys, each being mounted upon said support member adjacent one said terminus of said fourth linear locus of travel and each being freely rotatable about a given axis, a flexible cable having a predetermined length thereof wound in driven relationship about said second motor capstan and extending about said fifth pulley to a connection with said third translational bearing and extending about said eighth pulley to a connection with said fourth translational bearing.

10. The apparatus of claim 9 including a second follower flexible cable extending about said sixth pulley to a connection with said fourth translational bearing and extending about said seventh pulley to a connection with said third translational bearing.

11. The apparatus of claim 3 in which:

said first translational bearing includes a T-shaped polymeric first bearing component slidably mounted within a first slot formed within said support member and extending along said first linear locus of travel; and said second translational bearing includes a T-shaped polymeric second bearing component slidably mounted within a second slot formed within said support member and extending along said second linear locus of travel.

12. The apparatus of claim 4 in which:

said third translational bearing includes a T-shaped polymeric third bearing component slidably mounted within a third slot formed within said support member and extending along said third linear locus of travel; and said fourth translational bearing includes a T-shaped polymeric fourth bearing component slidably mounted within a fourth slot formed within said support member and extending along said fourth linear locus of travel.

13. The apparatus of claim 1 including a force coupler positioned intermediate said marker base inwardly disposed portion and said air bearing at said center for providing said coupling in force transfer relationship.

14. The apparatus of claim 13 in which said force coupler includes a rigid spherical component.

15. The apparatus of claim 1 in which said air bearing is a porous carbon air bearing.

16. The apparatus of claim 1 in which said marker base is formed of polyetherimide material.

17. Apparatus mountable with a support structure for marking a solid material surface with predetermined character-based information, comprising:

a head component formed of polyetherimide material, supported from said support structure, having a confronting surface positionable a predetermined distance from said material surface, a marker pin chamber within said head component, said chamber having a drive portion extending from a top position toward a seating surface and communicating with a shaft receiving portion extending from said seating surface toward an opening at said confronting surface;

a steel marker pin positioned within said chamber having a piston portion of predetermined first diameter pneumatically drivably movable between a first position adjacent said top position and said seating surface, and having a shaft portion of predetermined second diameter depending from said piston portion extending to an indentation tip;

a valve controlled pneumatic assembly configured to apply return air to said chamber in the vicinity of said seating surface, urging said piston portion to move toward said top position, and configured to apply drive air to said piston portion in the vicinity of said top position to drive said marker pin with a force selected to form an indentation by said indentation tip in said solid material surface.

18. The apparatus of claim 17 in which said valve controlled pneumatic assembly applies substantially lubricant-free air as said drive air and return air.

19. The apparatus of claim 17 including a connector assembly having a first connector component coupled to said head component and a second connector component removably coupled with said first connector component and supporting said head component against said support structure, said connector assembly being configured to distort along the direction of movement of said marker pin when said piston portion dynamically inpacts upon said seating surface in the absence of a contact between said indentation tip and said solid material surface.

20. The apparatus of claim 19 in which said connector assembly first and second connector components are configured as a draw latch.

21. Apparatus for marking solid material objects at a surface thereof, comprising:

a support member having a flat platen surface extending between field support defining peripheries:

a first cross bar assembly located a first predetermined distance outwardly from said platen surface, and extending between first and second said peripheries;

a first bearing assembly coupled with and supporting said first cross bar assembly at said first predermined distance and adjacent first and second ones of said peripheries and drivable to move said first cross bar assembly in a first coordinate sense:

a second cross bar assembly located a second predetermined distance outwardly from said platen surface and extending between third and fourth ones of said peripheries;

a second bearing assembly coupled with and supporting said second cross bar assembly at said second predetermined distance and adjacent said third and fourth peripheries, and drivable to move said second cross bar assembly in a second coordinate sense;

a motor assembly coupled in driving relationship with said first and second bearing assemblies for effecting the movement thereof;

a marker base having a first channel defining portion extending therethrough and slidably engaging said first cross bar assembly, having a second channel defining portion extending therethrough and slidably engaging said second cross bar assembly, said marker base having an inwardly disposed portion in spaced adjacency with said platen surface, an oppositely disposed marker support portion, and drivably movable by said first and second cross bar assemblies in said first and second coordinate senses;

an air bearing, having a center, located intermediate said marker base inwardly disposed portion and said platen surface, having a first pneumatic input for receiving air under pressure from a source having an air expressing bearing surface air supportable over said platen surface, movable with and coupled in force transfer relationship with said marker base;

a head component formed of polyetherimide material, having a confronting surface positionable a predetermined distance from said material surface, a marker pin chamber within said head component, said chamber having a drive portion extending from a top position toward a seating surface and communicating with a shaft receiving portion extending from said seating surface toward an opening at said confronting surface;

a steel marker pin positioned within said chamber having a piston portion of predetermined first diameter pneumatically drivably movable between a first position adjacent said top position and said seating surface, and having a shaft portion of predetermined second diameter depending from said piston portion extending to an indentation tip:

a valve controlled pneumatic assembly mounted upon said marker base at said marker support portion, coupled to said head component, having a second pneumatic input for receiving return air and applying said return air to said chamber in the vicinity of said seating surface urging said piston portion to move toward said top position, and having a third pneumatic input for applying drive air to said piston portion in the vicinity of said top position to drive said marker pin with a force selected to form an indentation by said indentation tip in said solid material surface.

22. The apparatus of claim 21 in which said air under pressure from said source applied to said first, second, and third pneumatic inputs is substantially lubricant free air.

23. The apparatus of claim 21 in which said first and third pneumatic inputs are coupled in parallel with said source of air under pressure.

24. The apparatus of claim 23 in which said air bearing is a porous carbon air bearing.

25. The apparatus of claim 21 in which said motor assembly comprises:

a first motor fixed to said support member and having a rotational output:

a first drive assembly connected in driven relationship with said first motor output and in driving relationship with said first bearing assembly;

a second motor fixed to said support member and having a rotational output; and a second drive assembly connected in driven relationship with said second motor output and in driving relationship with said first bearing assembly.

26. The apparatus of claim 23 in which said first bearing assembly comprises:

a first translational bearing mounted upon said support member, and coupled with said first drive assembly for driven movement between termini along a first linear locus of travel adjacent said first periphery;

a second translational bearing mounted upon said support member and coupled with said first drive assembly for driven movement between termini along a second linear locus of travel adjacent said second periphery;

a third translational bearing mounted upon said support member and coupled with said second drive assembly for driven movement between termini along a third linear locus of travel adjacent said third periphery; and a fourth translational bearing mounted upon said support member and coupled with said second drive assembly for driven movement between termini along a fourth linear locus of travel adjacent said fourth periphery.

27. The apparatus of claim 24 in which:

said first motor includes a capstan rotatable as said rotational output;

said first drive assembly comprises:

first and second pulleys, each being mounted upon said support member adjacent one said terminus of said first linear locus of travel and each being freely rotatable about a given axis, third and fourth pulleys, each being mounted upon said support member adjacent one said terminus of said second linear locus of travel and each being freely rotatable about a given axis, a first flexible cable having a predetermined length thereof wound in driven relationship about said first motor capstan and extending about said first pulley to a connection with said first translational bearing and extending about said fourth pulley to a connection with said second translational bearing;

said second motor includes a capstan rotatable as said rotational output; and said second drive assembly comprises:

fifth and sixth pulleys, each being mounted upon said support member adjacent one said terminus of said third linear locus of travel and each being rotatable about a given axis, seventh and eighth pulleys, each being mounted upon said support member adjacent one said terminus of said fourth linear locus of travel and each being freely rotatable about a given axis, a second flexible cable having a predetermined length thereof wound in driven relationship about said second motor capstan and extending about said fifth pulley to a connection with said third translational bearing and extending about said eighth pulley to a connection with said fourth translational bearing.

28. The apparatus of claim 27 including:

a first follower flexible cable extending about said second pulley to a connection with said first translational bearing and extending about said third pulley to a connection with said second translational bearing;

a second follower flexible cable extending about said sixth pulley to a connection with said fourth translational bearing and extending about said seventh pulley to a connection with said third translational bearing.

29. The apparatus of claim 21 including a force coupler positioned intermediate said marker base inwardly disposed portion and said air bearing at said center for providing said coupling in force transfer relationship.

30. The apparatus of claim 21 including a connector assembly having a first connector component coupled to said head component and a second connector component removably coupled with said first connector component and supporting said head component against said valve controlled pneumatic assembly, said connector assembly being configured to distort along the direction of movement of said marker pin when said piston portion dynamically inputs upon said seating surface in the absence of a contact between said indentation tip and said solid material surfaces.

31. Apparatus mountable with a support structure for marking a solid material surface with predetermined character-based information, comprising:

a head component, supported from said support structure, having a confronting surface positionable a predetermined distance from said material surface, a marker pin chamber within said head component, said chamber having a drive portion extending from a top position toward a seating surface and communicating with a shaft receiving portion extending from said seating surface toward an opening at said confronting surface;

a steel marker pin positioned within said chamber having a piston portion of predetermined first diameter, an upper drive surface and a return surface spaced therefrom, said marker pin being pneumatically drivably movable between a first position adjacent said top position and said seating surface, and having a shaft portion of predetermined second diameter depending from said piston portion extending to an indentation tip;

a valve controlled pneumatic assembly configured to apply return air to said chamber at a location spaced a predetermined distance upwardly from said seating surface, urging said piston portion to move toward said top position, and configured to apply drive air to said piston portion in the vicinity of said top position to drive said marker pin outwardly normally a select distance with a force selected to form an indentation by said indentation tip in said solid material surface, said predetermined distance being selected such that said port is blocked by said piston portion when said marker pin is driven outwardly a distance beyond said select distance

32. Apparatus mountable with a support structure for marking a solid material surface with predetermined character-based information, comprising:

a head component supported from said support structure, having a confronting surface positionable a predetermined distance from said material surface, a marker pin chamber within said head component, said chamber having a drive portion extending from a top position toward a seating surface and communicating with a shaft receiving portion extending from said seating surface toward an opening at said confronting surface;

a steel marker pin positioned within said chamber having a piston portion of diameter at least about $\frac{5}{8}$ inch, pneumatically drivably movable between a first position adjacent said top position and said seating surface, and having a shaft portion of predetermined diameter depending from said piston portion extending to an indentation tip, said marker pin having a weight of at least about 50 grams;

a valve controlled pneumatic assembly configured to apply return air to said chamber in the vicinity of said seating surface, urging said piston portion to move toward said top position, and configured to apply drive air to said piston portion in the vicinity of said top position to drive said marker pin with a force selected to form an indentation by said indentation tip in said solid material surface.

33. The apparatus of claim 32 in which said marker pin shaft portion has a diameter of about $\frac{3}{8}$ inch.

* * * * *